US008065964B2

(12) United States Patent
Forbes et al.

(10) Patent No.: US 8,065,964 B2
(45) Date of Patent: Nov. 29, 2011

(54) RAIL ROAD HOPPER CAR RIDGE FITTINGS

(75) Inventors: James W. Forbes, Campbellville (CA); Mohamed A. Khattab, Burlington (CA); Tomasz Bis, Ancaster (CA); William R. Davis, Beamsville (CA)

(73) Assignee: National Steel Car Limited (CA)

( * ) Notice: Subject to any disclaimer, the term of this patent is extended or adjusted under 35 U.S.C. 154(b) by 0 days.

(21) Appl. No.: 12/698,509

(22) Filed: Feb. 2, 2010

(65) Prior Publication Data

US 2010/0132587 A1 Jun. 3, 2010

Related U.S. Application Data

(62) Division of application No. 11/530,334, filed on Sep. 8, 2006, now Pat. No. 7,703,397.

(51) Int. Cl.
*B61D 3/00* (2006.01)
*B61D 39/00* (2006.01)

(52) U.S. Cl. ..... 105/247; 52/45

(58) Field of Classification Search ..... 105/238.1, 105/239, 247–249, 355, 396, 404, 406, 407, 105/411; 52/45–49
See application file for complete search history.

(56) References Cited

U.S. PATENT DOCUMENTS

| | | | | |
|---|---|---|---|---|
| 1,092,659 | A | 4/1914 | Mettler | |
| 1,706,353 | A | 3/1929 | Dorey | |
| 3,137,247 | A | 6/1964 | Hamilton et al. | |
| 3,596,609 | A | 8/1971 | Ortner et al. | |
| 4,136,621 | A | 1/1979 | Schuller et al. | |
| 4,213,725 | A | 7/1980 | Knippel | |
| 4,224,878 | A | 9/1980 | Marsden | |
| 4,262,603 | A | 4/1981 | Morse | |
| 4,291,631 | A | 9/1981 | Knippel | |
| 4,366,757 | A | 1/1983 | Funk | |
| 4,377,058 | A * | 3/1983 | Hallam et al. | 52/45 |
| 6,019,049 | A | 2/2000 | Gaydos et al. | |
| 6,899,038 | B2 | 5/2005 | Fortuna | |
| 6,955,126 | B2 | 10/2005 | Taylor | |
| 6,955,127 | B2 | 10/2005 | Taylor | |
| 7,080,599 | B2 | 7/2006 | Taylor | |
| 2005/0263032 | A1 | 12/2005 | Taylor | |
| 2006/0000384 | A1 | 1/2006 | Taylor | |
| 2006/0042500 | A1 | 3/2006 | Taylor | |
| 2006/0185552 | A1 | 8/2006 | Herzog et al. | |
| 2006/0185553 | A1 | 8/2006 | Taylor | |
| 2006/0254456 | A1 | 11/2006 | Taylor | |
| 2006/0272541 | A1 | 12/2006 | Taylor | |
| 2007/0068417 | A1 | 3/2007 | Taylor | |
| 2007/0107624 | A1 | 5/2007 | Taylor | |

* cited by examiner

*Primary Examiner* — Joe Morano, IV
*Assistant Examiner* — R. J. McCarry, Jr.
(74) *Attorney, Agent, or Firm* — Hahn Loeser & Parks LLP; Michael H. Minns

(57) ABSTRACT

A hopper car discharge section may be wide at the top and narrow at the bottom. Outflow is controlled by movable closure members. The hopper car has a plurality of hoppers of which two hoppers share a common ridge assembly. The ridge assembly forms a common mating and fit up location for the upper margins of the slope sheets of two lengthwise adjacent hoppers. The ridge assembly includes an horizontal center section and two end plates that angle upwardly outboard toward the top chords of the sidewalls. The ridge assembly stands proud of the upper margin of the respective adjacent slope sheets. A gusset is mounted between the adjacent slope sheets below the ridge plate such that the slope sheets and gusset form a reinforcement tube running across the car, the end plates forming the stems of a vertical T-section attached to the sidewall and overlapping the top chord.

20 Claims, 27 Drawing Sheets

RAIL ROAD HOPPER CAR RIDGE FITTINGS

This application claims the benefit under 35 USC 120 of priority on the basis of co-pending U.S. patent application Ser. No. 11/530,334 filed Sep. 8, 2006, the specification and drawings thereof being incorporated herein by reference.

FIELD OF THE INVENTION

This invention relates to the field of rail road freight cars, and, in particular to rail road freight cars such as may employ bottom unloading gates.

BACKGROUND

There are many kinds of rail road cars for carrying particulate material, be it sand or gravel aggregate, plastic pellets, grains, ores, potash, coal or other granular materials. These materials are not liquid, yet may in some ways tend to flow in a somewhat liquid-like manner. Many of those cars have an upper opening, or accessway of some kind, by which the particulate is loaded, and a lower opening, or accessway, or gate, by which the particulate material exits the car under the influence of gravity. Clearly, while the inlet opening need not necessarily have a movable gate (but may include a cover to discourage contamination of the lading or exposure of the lading to the wind), the outlet opening requires a governor of some kind that is movable between a closed position for retaining the lading while the lading is being transporting, and an open position for releasing the lading at the destination. The terminology "flow through" or "flow through rail road car" or "center flow" car, or the like, may sometimes be used for cars of this nature where lading is introduced at the top, and flows out at the bottom.

Consider, for example, a hopper car for transporting aggregate, be it gravel or sand. The hopper may have a converging hopper discharge section that has the shape, generally speaking, of an inverted four sided, truncated pyramid. At the truncated bottom end, there may be a stationary plate and a moving plate, or door. When the moving plate and the stationary plate are brought together, the door is closed. The car is filled with lading, and is hauled to its destination. At the destination, the gate is opened, and the lading is allowed to escape from the hopper. However, it sometimes happens that, for example, the car may move while the gate is still obstructed by lading, such that the gate may tend to "plow" the aggregate. This may not necessarily lead to the retention of the original geometry of the closure, and, after a time, the gate may tend not to close as well as it might originally have done, or as might be desired. A number of considerations arise from dealing with this kind of issue. First, it may be helpful to diminish, or to avoid, the tendency to distort the geometry of the door closure in the first place. Second, if the door seal region is prone to damage or abuse, it may be helpful to be able to replace the parts most likely to wear or be damaged relatively easily, rather than having to replace what might otherwise be considered permanent structure. Third, it is a consideration that parts employed in this kind of use may face an abrasive environment, even in normal, non-abusive operation. Fourth, particularly if the car is intended to be used with fine aggregates, such as sand, it may be desirable to employ a door seal that may tend to be somewhat tolerant of geometric mismatch, or creeping tolerances as parts are either damaged or bent out of shape.

SUMMARY OF THE INVENTION

In an aspect of the invention, there is a door seal member for a gate of a hopper of a rail road car. The door seal member has at least one fitting by which to secure the door seal member to one of (a) a movable closure member; and (b) another closure member co-operable with the movable member to form a closure. The door seal member also has a deflecting portion, and a land portion for engagement with the other of (a) the other member; and (b) the movable member. The deflecting portion is movable in a direction that, when the fitting is installed, includes an inward component of displacement relative to the hopper. The land portion is connected to the deflecting portion, and is movable to cause the deflecting portion to be displaced in that direction of closing of the hopper gate.

In another feature of that aspect of the invention, the door seal member stores energy when deflected. In an additional feature, the door seal member is made of a material having a rated yield strength of more than 70 ksi. In still another feature, the door seal member has a yield strength of greater than 100 ksi. In a further feature, the land and the deflecting portion are parts of a monolith. In yet another feature, the door seal member includes a bent lip located distant from the fitting, and the land is part of the bent lip. In a still further feature, the deflecting portion adjoins the fitting, and the land is formed on a portion of the door seal member connected to the deflecting portion distant from the fitting.

In still another feature, there is a door seal assembly that incorporates the door seal member of that aspect of the invention. The door seal assembly includes a second door seal member. The second door seal member has a proximal portion and a distal portion. The proximal portion is attachable to the same one of (a) the movable member; and (b) the stationary member, as the first door seal member. The distal portion extends away from the fitting, and has a first door seal member contact distant from the fitting. When assembled, the land of the first door seal member lies more distant from the fitting than the first door seal member contact of the second door seal member. At least a portion of the deflecting portion lies more proximate to the fitting than the contact. The first door seal member is movable in engagement with the contact when the movable member and the stationary member come together, and the land is deflected. In a further feature, the contact includes one of (a) a fulcrum; and (b) a rocker, against which the first door seal member acts. In still another feature, when assembled, the reinforcement is a backing member, and the land of the seal member is, when installed, cantilevered beyond the contact.

In another aspect of the invention, there is a door seal assembly for a closure of a hopper discharge section of a rail road hopper car. The discharge section is movable between a closed position for retaining lading in the hopper and an open position for permitting the release of lading from the hopper. The hopper discharge section includes a first closure member and a second closure member. At least one of the first and second closure members is movable. The first and second closure members are co-operable. The door seal assembly includes a first member and a co-operating second member. The first member and the second member are securable to the first closure member of the discharge section of the hopper. The first member, when installed, extends from the first closure member, and when installed, the second member presents a fulcrum to the first member. The first member has a first portion that, when installed, lies between a locus of securement thereof and the fulcrum. The first member, when installed, has a second portion cantilevered beyond the fulcrum.

In a feature of that aspect of the invention, the second portion includes a land that, on installation, is oriented to face predominantly toward the second closure member, and is operable to engage at least a portion of the second closure member when the first and second closure members come together. In another feature, in operation, the second portion engages at least a portion of the second closure member, and, when so engaged, the second portion deflects in a first direction, and the first portion deflects in a reactive direction. In a further feature, the reactive direction is a direction that includes a component of direction that is inwardly with respect to the hopper. In a still further feature, when the first and second closure members are in a closed condition the first portion of the first seal member is exposed to lading placed in the hopper, and the first portion of the first seal member is operable under the influence of lading bearing thereagainst to cause the second portion of the first seal member to bear more tightly against the second closure member.

In still another feature, in operation, the second portion of the first member of the door seal assembly deflects in a first direction on engagement of the first and second closure members, and the first portion of the first member deflects in a predominantly opposite direction. In yet another feature, as installed, the first portion of the first seal member faces inwardly toward, and is exposed to, lading borne by the hopper, and the first portion is operable under the influence of lading bearing thereagainst to urge the second portion of the first seal member to bear more forcefully against the second closure member. In another feature, the first seal member has an intermediate portion between the first and second portions thereof, and, in operation, the intermediate portion works against the fulcrum as the first and second closure members come together. In another further feature, the first seal member has a locus of contact against the fulcrum, and has slope continuity at that locus of contact. In another feature, the first seal member is operable to carry a bending moment across the fulcrum between the first and second portions of the first seal member. In a further feature, the second portion of the first seal member includes a bent lip. In still another feature, the fulcrum of the second member is cantilevered away from the first closure member of the discharge section.

In still another aspect of the invention, there is a hopper discharge section of a rail road hopper car, the discharge section being movable between a closed position for retaining lading in the hopper to a open position for permitting release of lading from the hopper. The hopper discharge section includes a first closure member and a second closure member. At least one of the first and second closure members is movable, and the first and second closure members are co-operable. The discharge section also includes a door seal assembly. The door seal assembly includes a first member and a co-operating second member. The first member and the second member are securable to the first closure member of the discharge section of the hopper. In the open condition, the first closure member includes a hopper slope sheet extension, the hopper slope sheet extension providing a surface against which lading to be discharged may slide, the surface having an angle of inclination. The first member is mountable to extend from the first closure member, and the second member is mountable to present a fulcrum to the first member. The first member has a first portion that, when installed, lies between the fulcrum and the discharge portion of the hopper, and a second portion cantilevered beyond the fulcrum. In the open condition, the first member lies in a position that is one of (a) substantially flush with; and (b) shy of, the surface of the slope sheet extension.

In another feature of that aspect of the invention, in the closed condition, at least part of the first portion of the first member of the seal assembly is located in a position that is proud of the position of that member when the door is open. In a further feature, in the closed condition, at least part of the first portion of the first member of the seal assembly lies proud of the surface of the slope sheet.

In another aspect of the invention there is a hopper discharge section that has substantial structural reinforcement closely adjacent to the lower margin of the hopper at which the hopper discharge section has closure members, of which at least one is movable. In a feature of that aspect of the invention, the closure members may be reinforced along their outwardly facing sides by substantial structural members. In one feature, those structural members may form closed hollow sections. In another feature, the distal margin of a movable closure member has a substantial structural reinforcement running therealong. In an additional feature, the reinforcement of the door margin may be a channel section. In another feature, the margin may include a doubler plate.

In another aspect of the invention, there is a method of operating a discharge section of a hopper car. The method includes establishing the car in an empty condition. A pair of closure members of the discharge section are brought together, that bringing together activating a seal member. The step of activating includes causing a part of the seal member to deflect inwardly relative to the hopper. In another feature, the method includes introducing lading into the hopper to bear against a portion of the seal member, and, in so bearing, causing the seal to seat more tightly.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
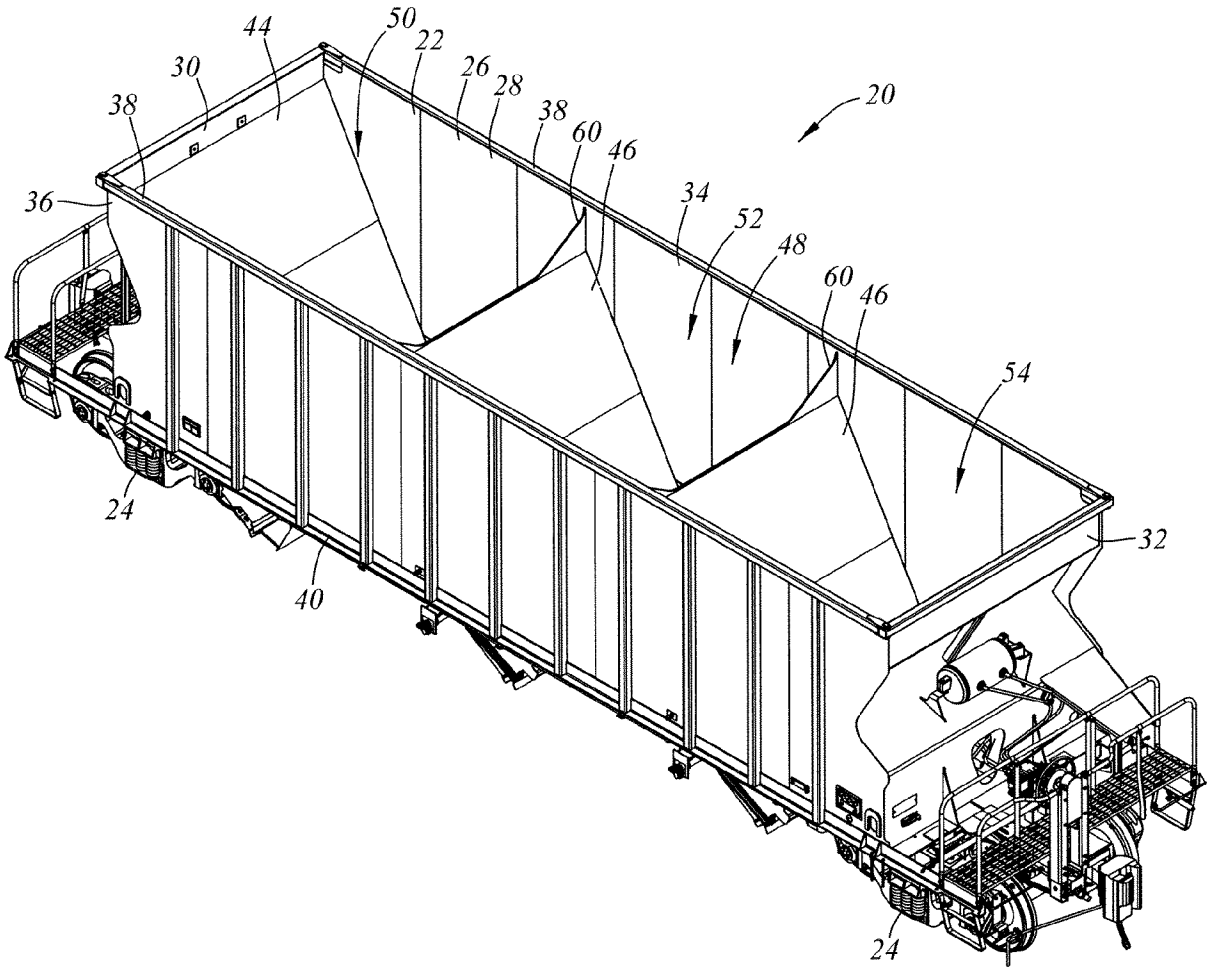
FIG. 1*a* is a general arrangement, isometric view of a rail road freight car.

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

The terminology used in this specification is thought to be consistent with the customary and ordinary meanings of those terms as they would be understood by a person of ordinary skill in the rail road industry in North America. Following from decision of the CAFC in Phillips v. AWH Corp., the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of at least 10 years experience in the rail road industry in North America or in other former territories of the British Empire and Commonwealth.

In terms of general orientation and directional nomenclature, for rail road cars described herein the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the rail road car described herein may tend to have both longitudinal and transverse axes of symmetry, a description of one half of the car may generally also be intended to describe the other half as well, allowing for differences between right hand and left hand parts. In this description, the abbreviation kspi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

FIG. 1*a* shows an isometric view of an example of a rail road freight car 20 that is intended to be representative of a wide range of rail road cars in which the present invention may be incorporated. While car 20 may be suitable for a variety of general purpose uses, it may be taken as being symbolic of, and in some ways a generic example of, a flow through car, in which lading is introduced by gravity flow from above, and removed by gravity discharge through gated or valved outlets below. Flow through, or center flow cars may include open topped hopper cars, grain cars, plastic pellet cars, potash cars, ore cars, and so on. In one embodiment car 20 may be a hopper car such as may be used for the carriage of bulk commodities in the form of a granular particulate, be it in the nature of relatively coarse gravel or fine aggregate in the nature of fine gravel or sand or various ores or concentrate or coal. Car 20 may be symmetrical about both its longitudinal and transverse, or lateral, centerline axes. Consequently, it will be understood that the car has first and second, left and right hand side beams, bolsters and so on.

By way of a general overview, car 20 may have a car body 22 that is carried on trucks 24 for rolling operation along railroad tracks. Car 20 may be a single unit car, or it may be a multi-unit car having two or more car body units, where the multiple car body units may be connected at an articulated connector, or by draw bars. Car body 22 may have a lading containment vessel or shell 26 such as may include an upstanding wall structure 28 which may have a pair of opposed first and second end walls 30, 32, that extend crosswise, and a pair of first and second sidewalls 34, 36 that extend lengthwise, the end walls 30, 32 and sidewalls 34, 36 co-operating to define a generally rectangular form of peripheral wall structure 28. Wall structure 28 may include top chords 38 running along the top of the walls, and side sills 40 running fore-and-aft along lower portions the side sheets of sidewalls 34, 36. In some instances car 20 may have stub center sills at either end, in which case sidewalls 34, 36 may act as deep beams, and may carry vertical loads to main bolsters that extend laterally from the centerplates. Alternatively, or in addition to deep side beams, car 20 may include a center sill 42, which may be a straight-through center sill, running from one end of the car body to the other. In the case of a single, stand alone car unit, draft gear and releasable couplers may be mounted at either end of the center sill. In a center flow, or flow through car, the upper portion of the car may typically include means by which to admit lading under a gravity drop system. Such an intake, or entryway may be a large rectangular opening such as bounded by top chords 38, or the car may have one or more hatches, whether covered or uncovered.

Figure 1C:
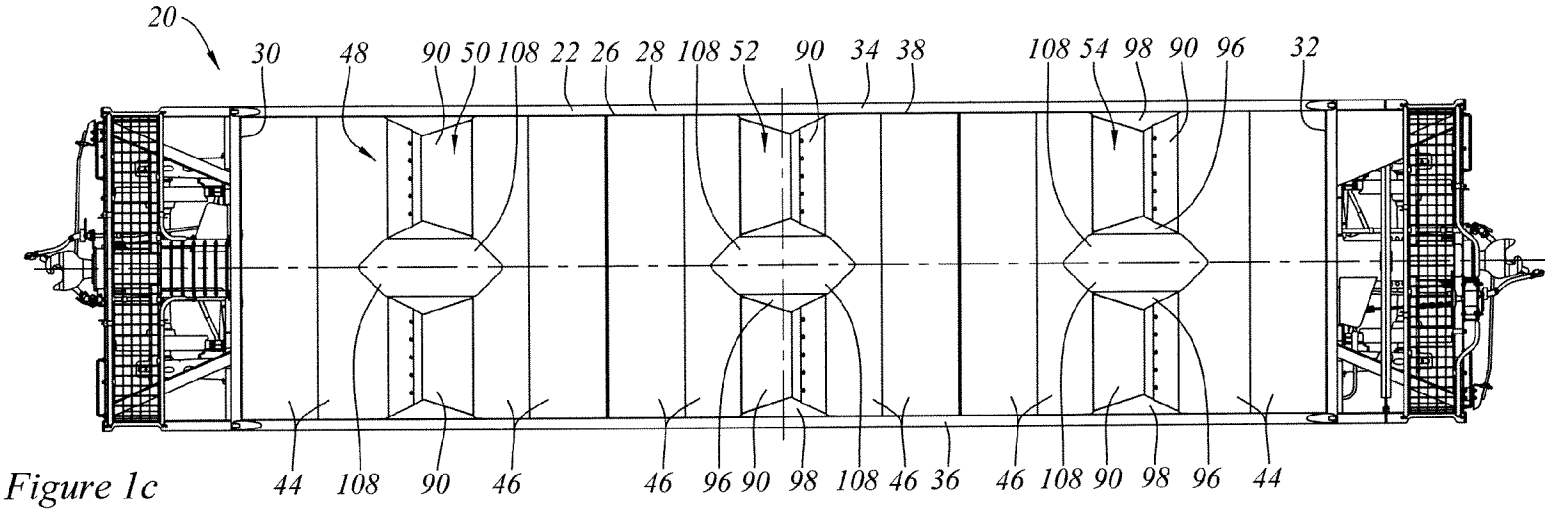
FIG. 1*c* is a top view of the rail road freight car of FIG. 1*a;*
Figure 1B:
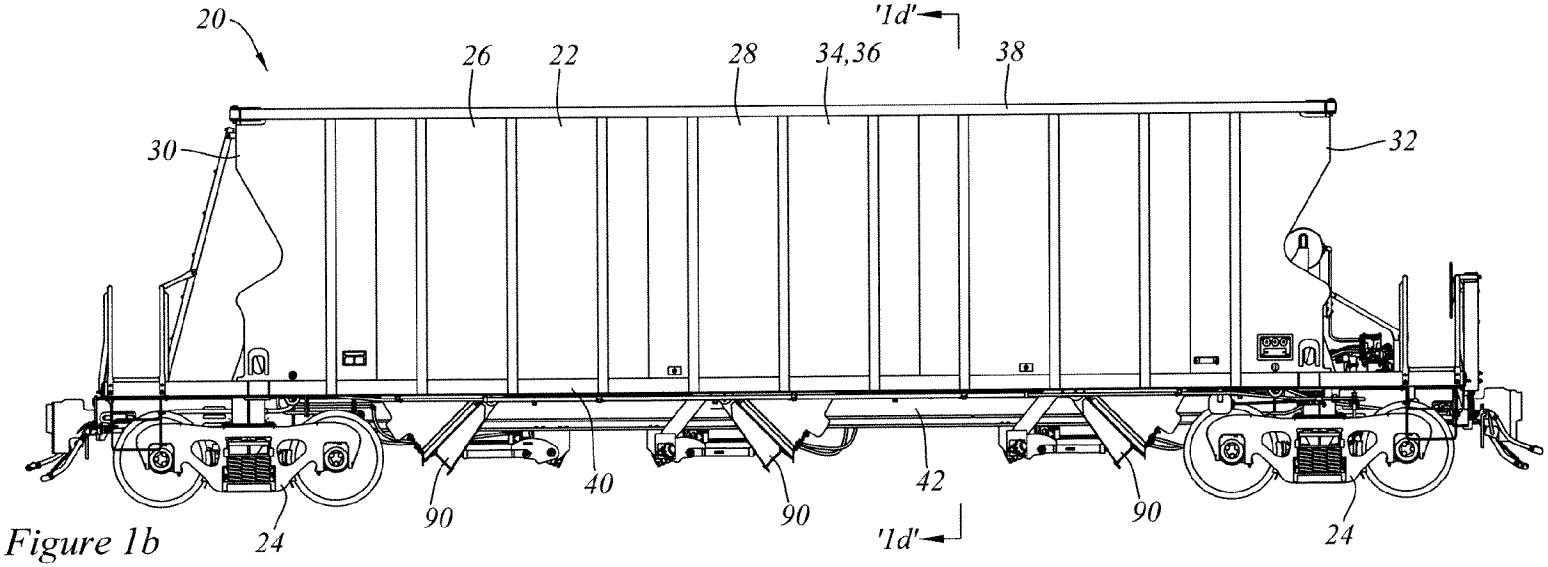
FIG. 1*b* is a side view of the rail road freight car of FIG. 1*a;*

As shown in FIG. 1*c*, the interior of car body 22 may include end slope sheets 44 and lateral partitions such as may be identified as intermediate slope sheets 46 that may extend between the sidewalls of the car, in a manner such as may tend to divide the internal space 48 of car body 22 into two or more sub-compartments, sub-volumes or subspaces indicated generally as 50, 52 and 54 in this example, and which may be referred to as hoppers. Clearly, in some embodiments there may be one single hopper, in others two hoppers and in others three, four, or more hoppers. As may be noted, end sheets 44 may be slope sheets, and internal partition sheets 46 may also be slope sheets. Not atypically, each pair of fore-and aft opposed slope sheets, be they end sheets or internal partitions, may be inclined at equal and opposite angles, and the angles of those sheets may be selected to be somewhat steeper than the free slope angle, or natural talus slope angle of the lading for which the car is designed, such that, when the gates are opened, the lading may tend to flow out, rather than sit at rest.

Car 20 may have relatively large slope sheets, be they 44 or 46, which may tend to extend to a height relatively close to top chords 38. That is, taking either the coupler centerline height or the center sill cover plate upper surface as a datum, slope sheets 46 may terminate at a height that is at least half way to top chord 38, and which may, in some embodiments, extend more than ⅔, ¾ or ⅘ of that distance, as may be.

Figure 2A:
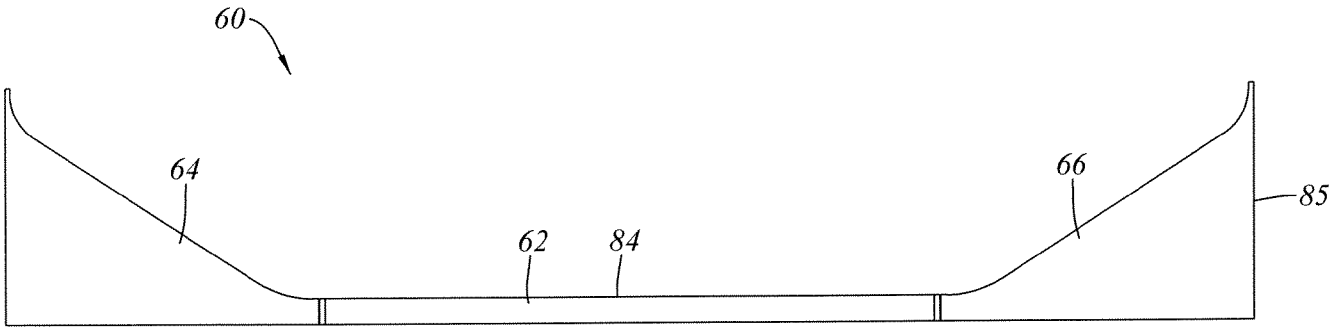
FIG. 2*a* is a plan view of a ridge plate member for the freight car of FIG. 1*a;*
Figure 1E:
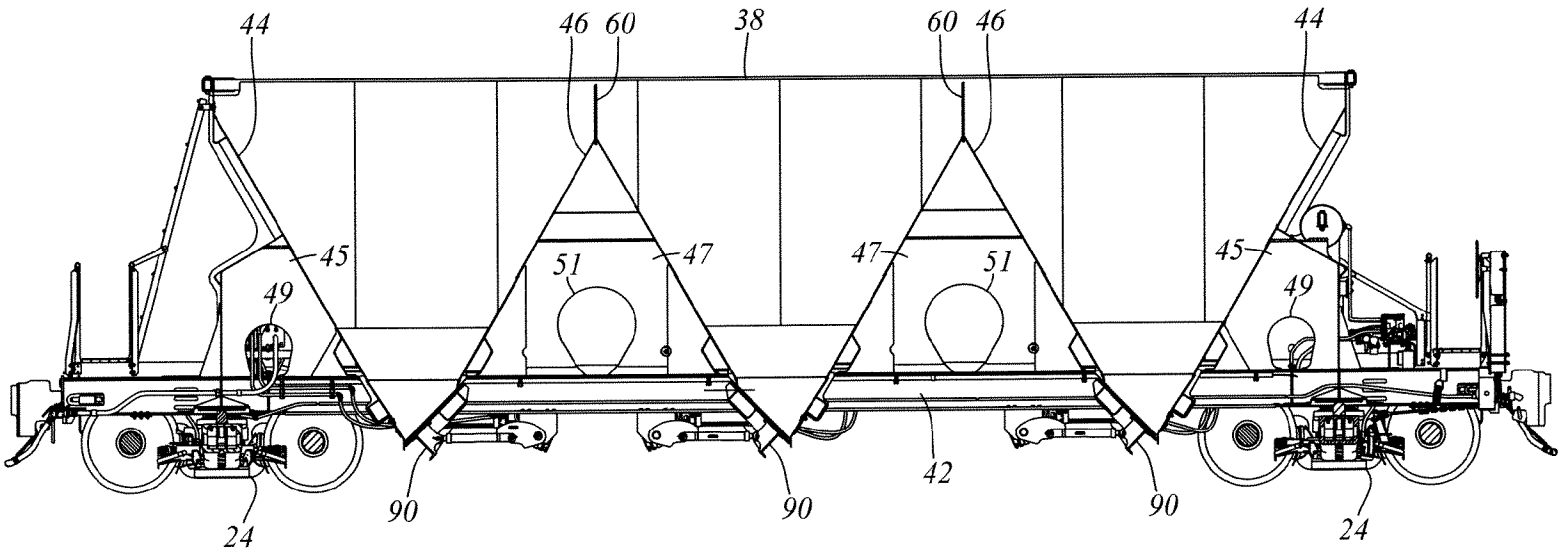
FIG. 1*e* is a longitudinal cross-section of the rail road freight car of FIG. 1*a*, taken on section '1*e*-1*e*' of FIG. 1*d;*
Figure 2C:
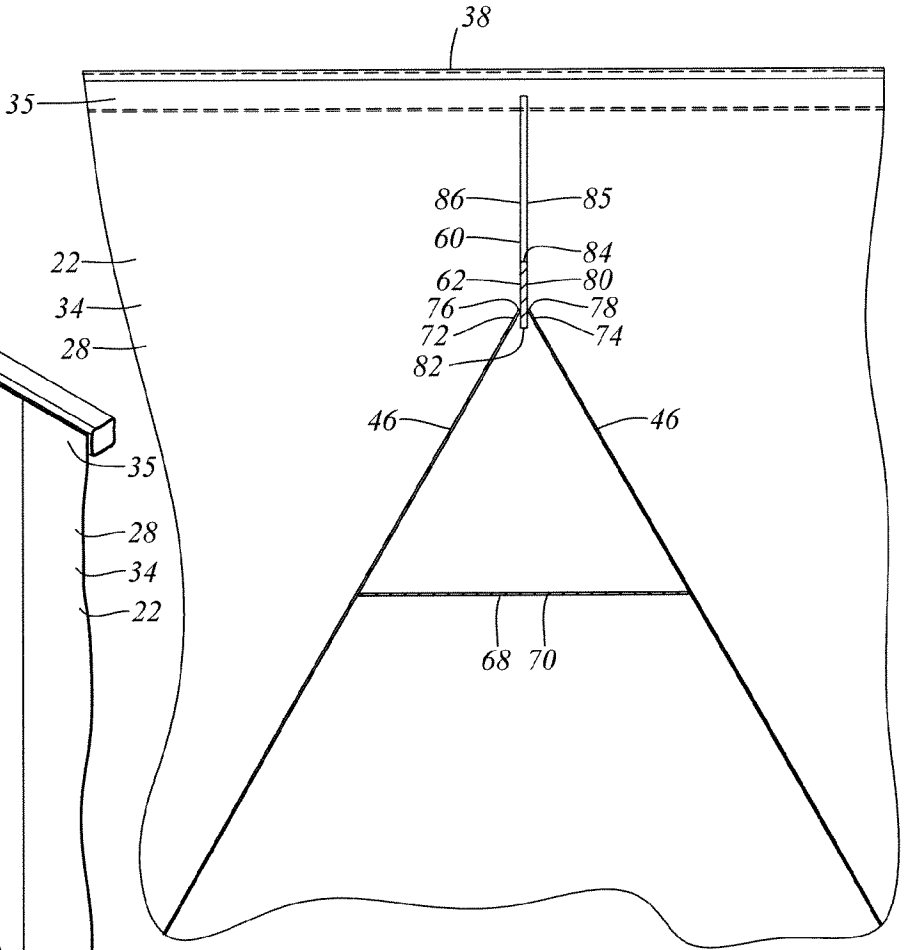
FIG. 2*c* is an enlarged detail of the railroad freight car of FIG. 1*e.*
Figure 2B:
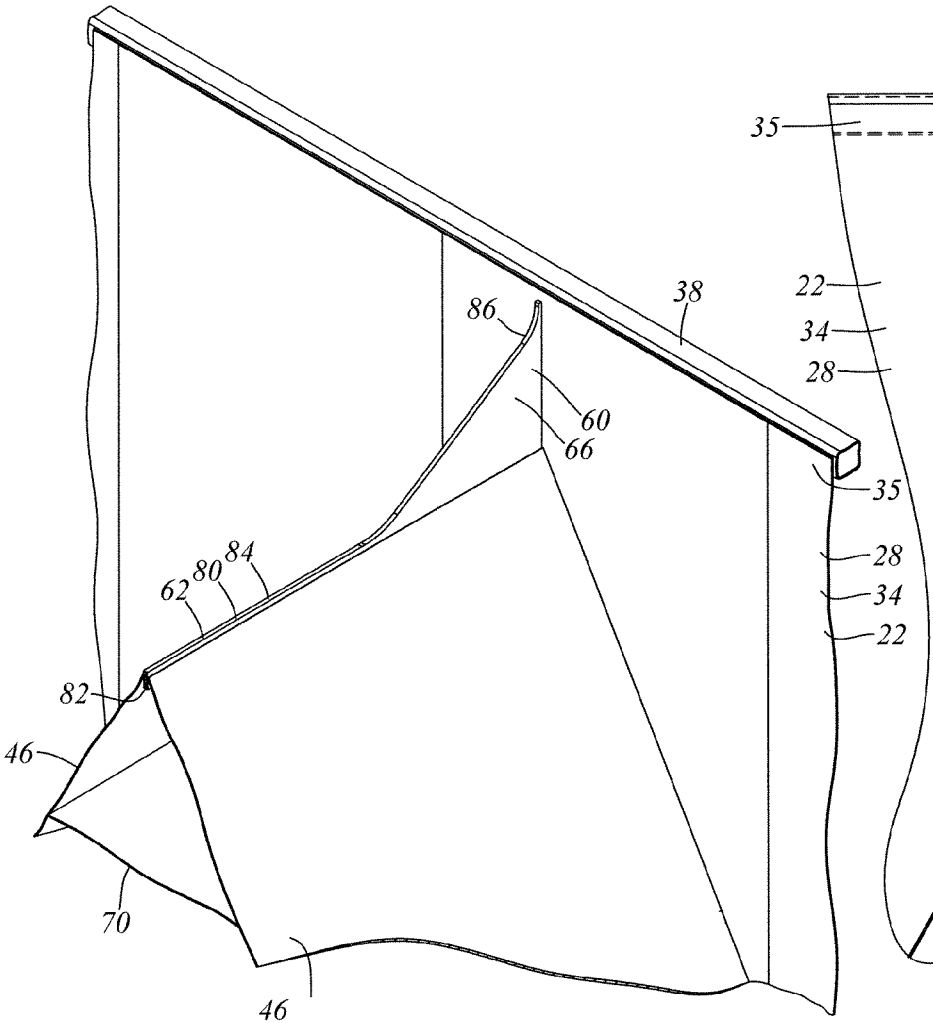
FIG. 2*b* is an isometric detail of the ridge plate of FIG. 2*a*, as installed.

Car 20 may include a fitting 60 mounted at the apex where two adjacent slope sheets 46 meet. Fitting 60 may be termed a partition, or a divider, or a reinforcement. Although any of those terms may be used, fitting 60 may be referred to as a ridge plate. As seen in the plan view of FIG. 2*a*, ridge plate 60 may include a central portion 62, and end portions 64, 66. Central portion 62 may be formed of a flat bar, which may be of substantial thickness, be it ½ inch, ⅝ inch, ¾ inch, or some different dimension.

It may be that ridge plate 60 is formed of a single monolithic part, cut to shape. Alternatively, the components of ridge plate 60, namely items 62, 64 and 66, may each be individually cut to shape, e.g., from a sheet or plate, and then assembled, typically by being butt welded together to yield the form shown in FIG. 2*a*. On assembly, or sub-assembly, slope sheets 46 may be mounted together in a jig, along with ridge plate 60, and a laterally extending cross-gusset 70. Rather than having a single large fillet at the adjoining margins 72, 74 of slope sheets 46, (as would occur absent fitting 60) fillets may be formed on either side of ridge plate 60, as indicated at 76, 78. Ridge plate 60 is positioned such that a portion thereof, identified as upper portion 80 extends upwardly proud of the junction of slope sheets 46, or, indeed, what would be the location of the junction of those sheets but for the interposition of ridge plate 60. Ridge plate 60 may also include a lower portion 82, that extends lower than this junction. The width of ridgeplate 60 (i.e., in the vertical direction) may permit it to function, inter alia, as a backing bar for welding, that presents a significant dimensional tolerance for fit up on either side. Furthermore, the upper margin 84 of upper portion 80 may provide a solid, hard edge of relatively thick material that may tend to resist abuse perhaps somewhat better than might a more conventional apex.

Ridgeplate 60 may, in one embodiment, have a constant cross-section, such as that of portion 62, at all locations across the car, from side sheet to side sheet. Alternatively, end portions 64, 66 may have a generally triangular shape and may, along its upper margin have an arcuate or angularly inclined profile, and may extend generally upwardly in the outboard direction. This profile may be such that ridgeplate 60 has an outboard margin 85 that mates with, and extends upwardly against, side sheet 35, in a manner to form a stem such as may tend locally to discourage lateral deflection of top chord 38. In one embodiment, at least a portion 86 of margin 85 may extend to a height that lies upwardly of the lower margin of top chord 38. Top chord 38 may be an angle or channel, or hollow structural section, such as a square or rectangular steel tube, and side sheet 35 may overlap the inner face of top chord 38.

It may also be noted that a triangular tube 68 is formed by the co-operation of slope sheets 46 and the horizontal plate defined by cross-gusset 70. This tube may extend from side sheet to side sheet, and may be welded thereto. End portions 64, 66, working in conjunction with side sheets 35, may tend to form a stem of a T-section to which side sheet 35 forms the cross-piece or flange, by which the stiffening influence of the triangular tube is extended to the top chord. Expressed somewhat differently yet again, the combination of the tube and the two stems may tend to function in a manner akin to a spring that may resist lateral deflection of the top chords. In terms of vertical scale, the central portion 62 of ridgeplate fitting 60 may be relatively small as compared to the lineal run or vertical rise of either slope sheet 46 or end slope sheet 44. For example, it may be less than 20% of either of those distances, and may be of lesser magnitude than the depth of the top chord or half the depth of the center sill. In other comparative terms, the depth of the central portion 62 of ridgeplate fitting 60 may be less that the depth of tube 68 from cross-gusset 70 to the apex at the intersection of the planes of the upper surfaces of the adjacent slope sheets. The height of cross-gusset 70 may, itself, be more than half way to the height of the top chord upper flange, as measured from with the coupler centerline or from the center sill top cover plate upper surface. In absolute terms, the central portion of ridgeplate fitting 60 may be less than 1 ft, and may, in one embodiment be less than 6 inches in depth.

Figure 1D:
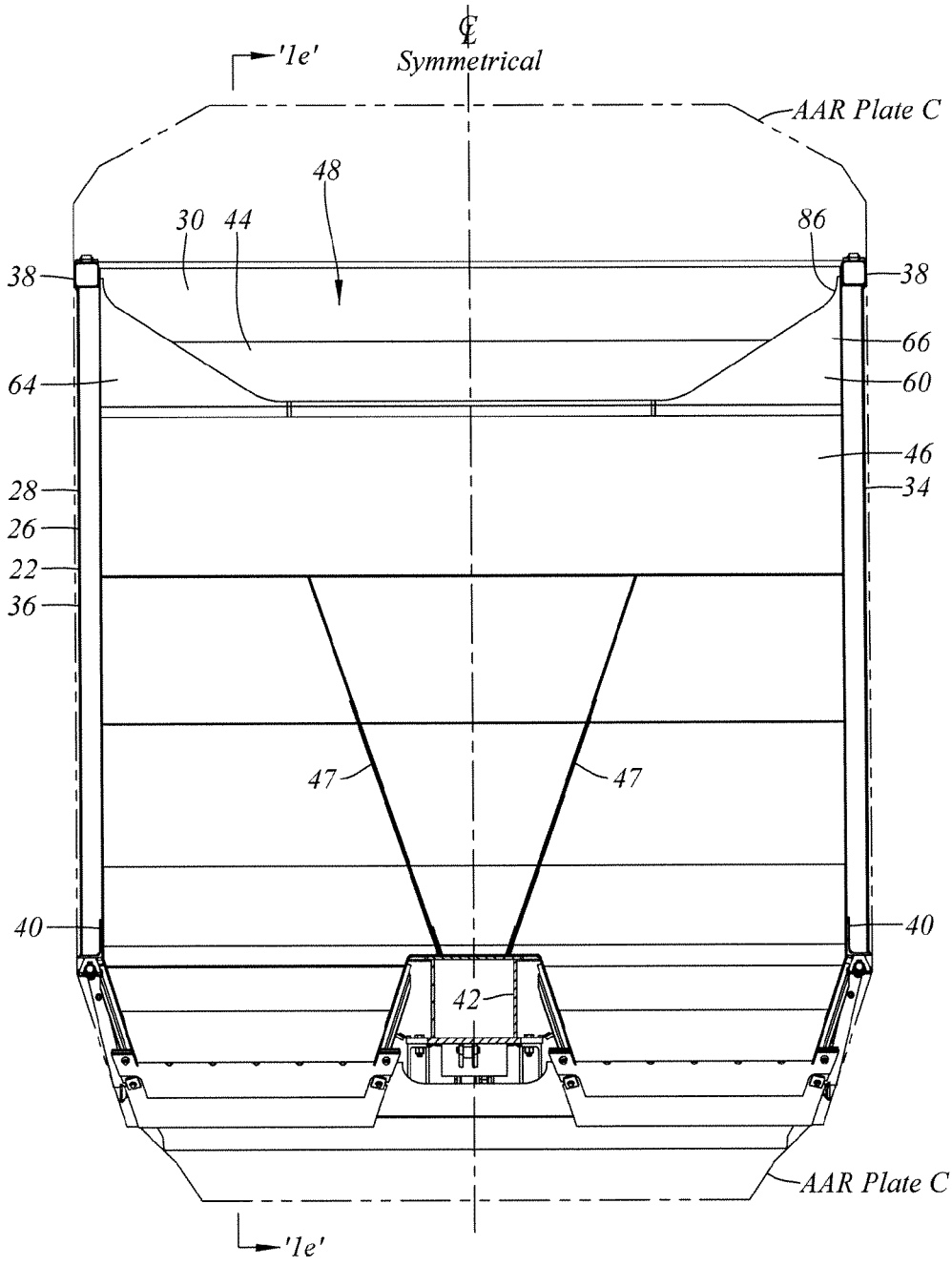
FIG. 1*d* is lateral cross-section of the rail road freight car of FIG. 1*a*, taken on section '1*d*-1*d*' of FIG. 1*b;*

Slope sheets 44 and 46 may have relatively large spans. So that the spans might not be unsupported, car 20 may include intermediate shear web panels 45 (associated with end slope sheets 44) and 47 (associated with intermediate slope sheets 46) that may extend amidst the otherwise unsupported span and provide a link to center sill 42. Pairs of panels 45 and 47 may be laterally outwardly splayed with respect to one another as seen, for example, in FIG. 1*d*. Panels 45 and 47 may include lightening apertures as indicated at 49 and 51.

The lower regions of car body 22 may include gate or discharge assemblies 90, for the various hoppers, however many there may be, by which one or more members that are movable between closed and open positions may be used as a flow control to govern the egress of lading from that hopper.

Figure 3B:
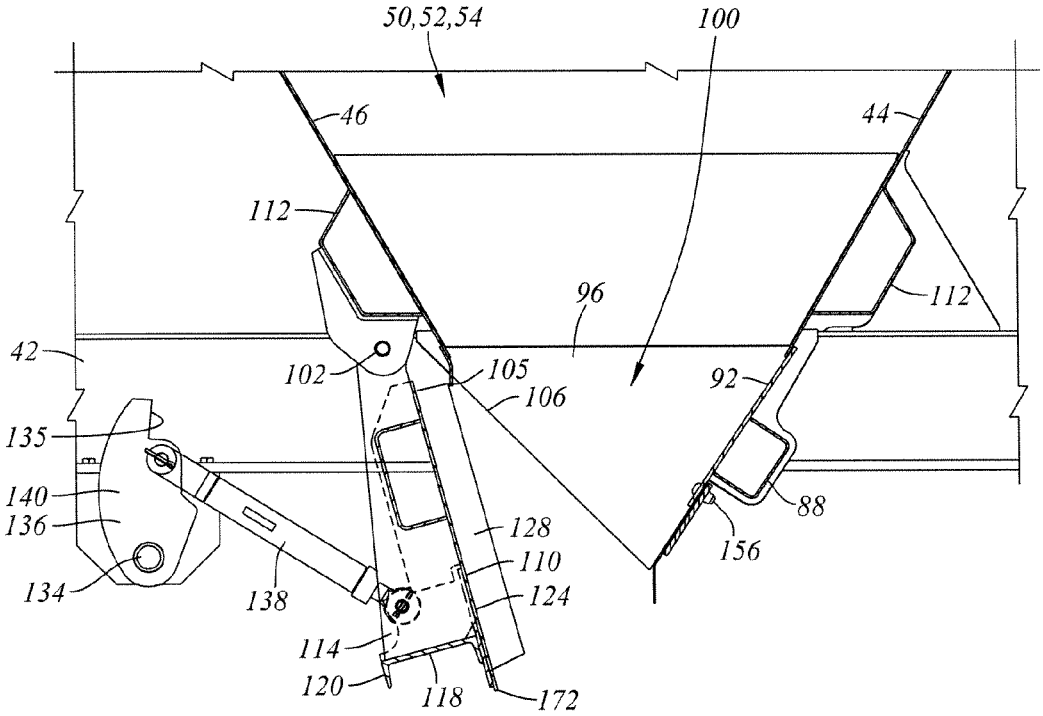
FIG. 3*b* is a view similar to FIG. 3*a*, but with the gate in an open condition.
Figure 3A:
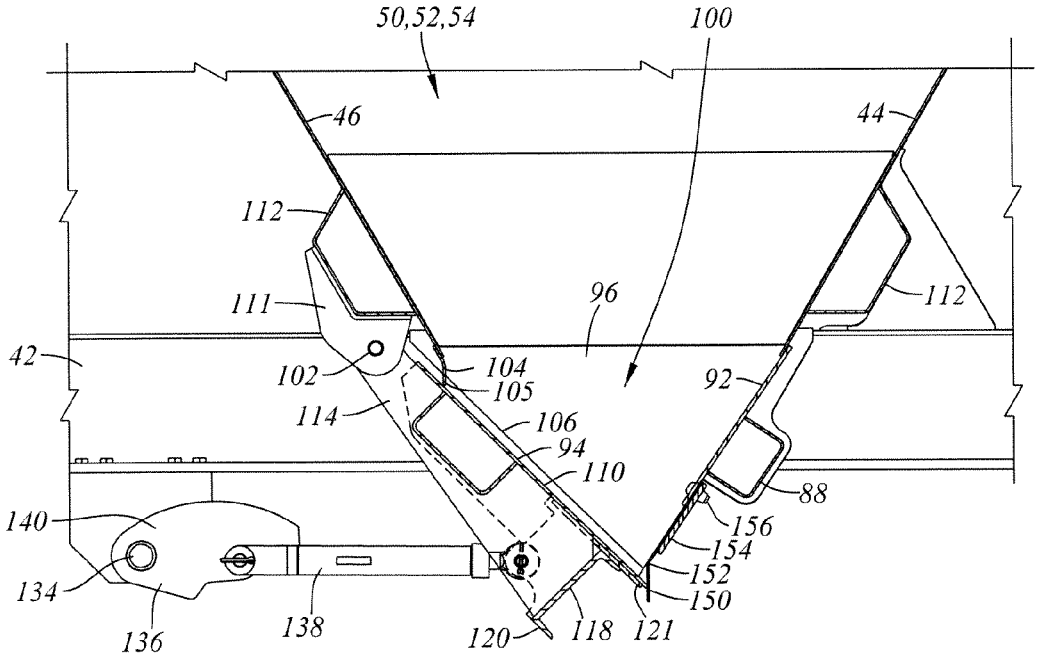
FIG. 3*a* is an enlarged detail of the side view of FIG. 1*a*, showing a hopper discharge assembly with a gate in a closed position.
Figure 3C:
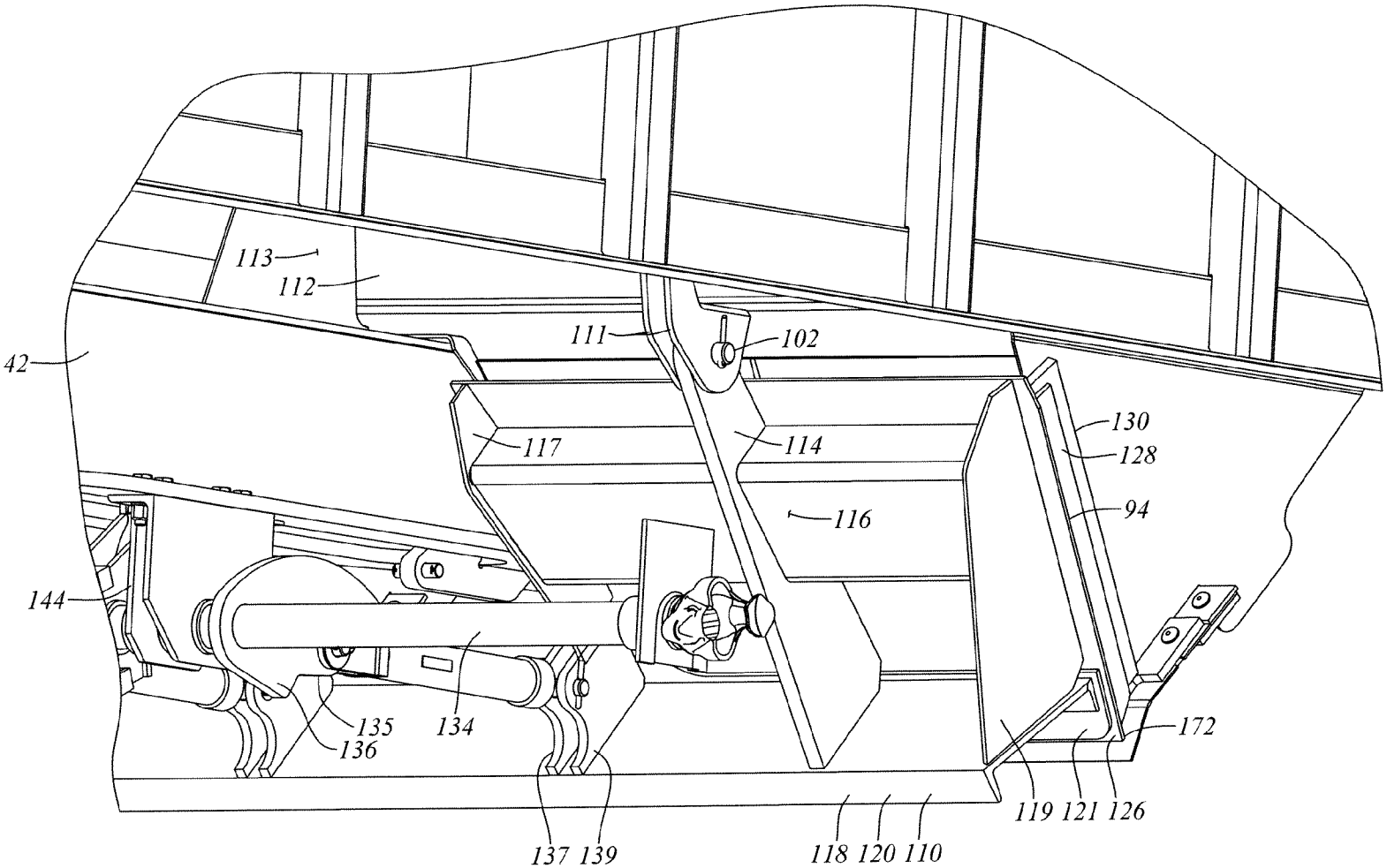
FIG. 3*c* shows a rear perspective view of a movable closure member of the gate of FIG. 3*b* under construction with side sill and outboard side sheet removed.
Figure 3D:
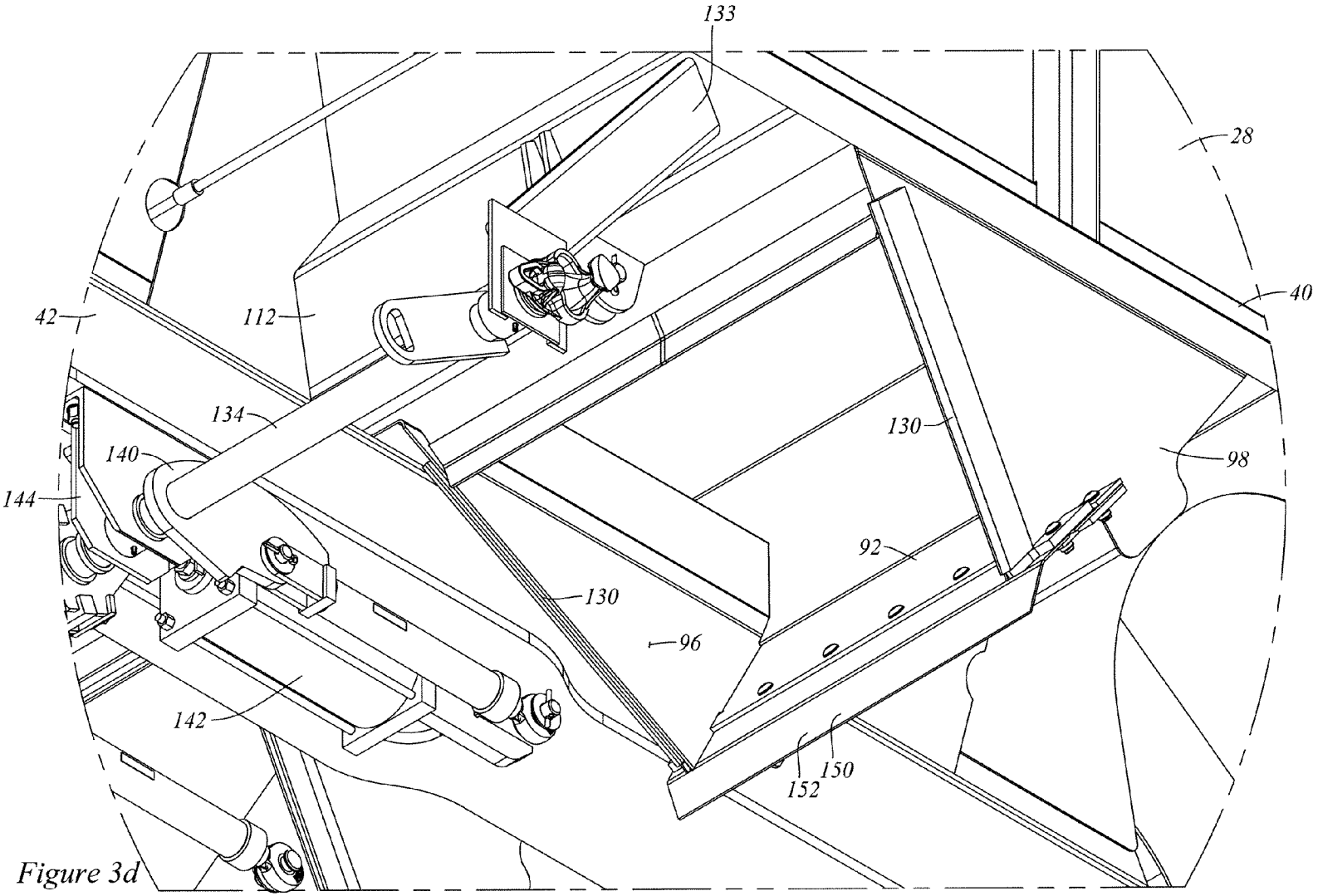
FIG. 3*d* shows an isometric view of the discharge assembly of FIG. 3*a* taken from below, outboard, and behind the door crank, with the movable door removed to reveal the geometry of the hopper discharge throat.

Referring to FIG. 3*a*, the discharge assemblies 90 may include the lower portion of, or a continuation of, one or both of the fore-and-aft slope sheets defining the fore and aft walls of that hopper. For example, hopper 50 (it being chosen arbitrarily, and generically) may include a first fore-and-aft hopper slope sheet extension 92, mounted to one slope sheet, e.g., item 44, and a second fore-and-aft slope sheet extension 94 mounted to an opposed slope sheet, e.g., be it item 46.

Discharge assemblies 90 may also include a pair of opposed side sheet members, 96, 98. Side sheet members 96, 98 may be steel plates, and may be positioned to co-operate with slope sheet extension 92 to define a converging, or funnel-like passageway, or conduit, leading to a throat, or opening, indicated generally as 100, at which an exit, or port, or gate, however it may be termed, is defined. In particular, the sides of the periphery of discharge opening 100 may be defined by the margins 106 of side sheet members 96 and 98 that angle upwardly and away from slope sheet extension 92. The bottom edge, or sill, of the discharge opening may be defined by the lowest margin or extremity of slope sheet extension 92, or such fittings or assemblies as may be mounted thereto, as may be described hereinbelow. First slope sheet extension 92 may be a panel that is rigidly fixed relative to the first slope sheet, and may be made from a metal, such as a steel, that may serve as a wear plate, and which may be hardened or alloyed for such a purpose. Slope sheet extension 92 may be reinforced along its lower lateral margin by a lip stiffening member 88, which may be a U-pressing, or channel, mounted to the outside face of extension 92 and forming a hollow section therewith, capped by the wings, or tabs 56 of side sheet members 96, 98.

Slope sheet extension 94 may be a movable slope sheet extension, and may be, or may be part of, a moveable closure member or closure assembly that is mounted to move between a closed position (FIG. 3*a*) obstructing flow through throat 100, and an open position (FIG. 3*b*) in which flow through throat 100 is less obstructed, such that lading may be discharged. To that end, slope sheet extension 94 may be connected to the rest of body 22 at a hinged or pivoted member, such as a pivot pin or hinge 102, such as may tend to constrain slope sheet extension 94 to a single degree of motion relative to opening 100, which, in one embodiment, may be angular displacement (i.e., rocking or pivoting motion, about an axis, such as the axis of hinge 102). By virtue of its motion, slope sheet extension 94 may be considered to be, or to be part of, a door or door assembly, or closure, or closure assembly such as may be referred to generally as 110. A shroud 104, which may be flexible, may be mounted along the nether edge of the slope sheet, be it 44 or 46, and may have a depending margin 105 that engages the upper laterally extending margin of extension 94. Shroud 104 may be biased to maintain contact with extension 94 and may be mounted to the underside of sheet 44 or 46.

Where car 20 includes a straight through center sill, such as item 42, rather than having a single full width hopper discharge assembly 90, such as might tend to be centered on the longitudinal centerline of the car, there may be two such discharge assemblies 90, one mounted to either side of center sill 42, in car 20. In this latter case, the center sill may tend to be protected from abrasion or other damage by one or more shrouds 108. Shroud 108 may, in cross-section, have the form of an inverted V, whose arms may extend on an incline upwardly from the upper, laterally inboard margin of inboard side sheet members 96, to meet at an apex above center sill 42 along the centerline of the car.

Considering now door assembly 110, as a preliminary matter it may be noted that the lower laterally running margins of the slope sheets, be they items 44 or 46, may be reinforced by a lateral margin reinforcement member, 112. Member 112 may be such as to have, or to co-operate with the respective slope sheet to yield, a closed periphery hollow section, i.e., a hollow tube, that may be capped inboard by a web 113, and outboard by side sheet 115 (FIG. 3*e*) of the hopper (whichever it may be), thus providing a shear web to discourage deformation of the tube section. The tube so created may tend to add an aspect of robustness to the structure, and may tend to discourage dimensional distortion along the margin, and hence along the hinge and along the slope sheet extensions, as may be. In one embodiment, member 112 may be a generally channel shaped U-pressing, which may have somewhat splayed legs, the toes of the legs being mounted against, and welded to, the slope sheet, and the back standing outwardly therefrom.

Door assembly 110 may include motion accommodating, or motion permitting, fittings, such as hinge 102. Hinge 102 may be received in a pivoting arm member, 114 which, itself may nest between webs 111 defining a clevis. Arm member 114 as may run along the back of the door pan sheet, or wing, defined by extension 94. Arm member 114 may extend generally radially away from hinge 102 toward the distal margin of extension 94, and may be a substantially planar member lying in a plane perpendicular to the axis of hinge 102. Given that hopper doors seem to be prone to abuse in service, extension sheet 94 may have a laterally extending reinforcement 116 that may run across the back of extension 94, not overly far from hinge 102. Reinforcement 116 may have, or may co-operate with extension 94 to define, a hollow structural section, which may include either internal shear webs, (one of which may be defined by the body of pivoting arm member 114 itself), or end caps defined by the inboard and outboard stiffeners 117, 119 of door assembly 110. Reinforcement 116 may have the general form of a channel having toes welded to extension 94, and may be a U-pressing. Door assembly 110 may be reinforced along the distal edge of the door by yet another lateral reinforcement member 118. In one embodiment, member 118 may have the form of a channel section 120, which may be mounted with one leg welded flat to the back of sheet 94, quite near the distal margin of extension 94. Once again, member 118 may provide a certain robustness of structure, such as may tend to discourage distortion of the distal margin of sheet 94 when the car moves with the door acting as something of an unintentional plow while the discharge section is still obstructed by the lading being discharged. In addition, either extension 94 may be thicker along its distal margin, or a further backing or reinforcement member such as a doubler 121 may be located between channel section 120 and extension 94. Reinforcement member 118 may extend not only across the back of door assembly 110, but also across the back of the adjacent opposite handed door assembly 110 mounted on the opposite side of the car such that the two door assemblies may be yoked together. Door assembly 110 may also include end webs or end gussets, namely stiffeners 117, 119, such as may tend to run predominantly radially along the back of extension 94 near to the predominantly radially extending margins of extension 94.

Figure 3E:
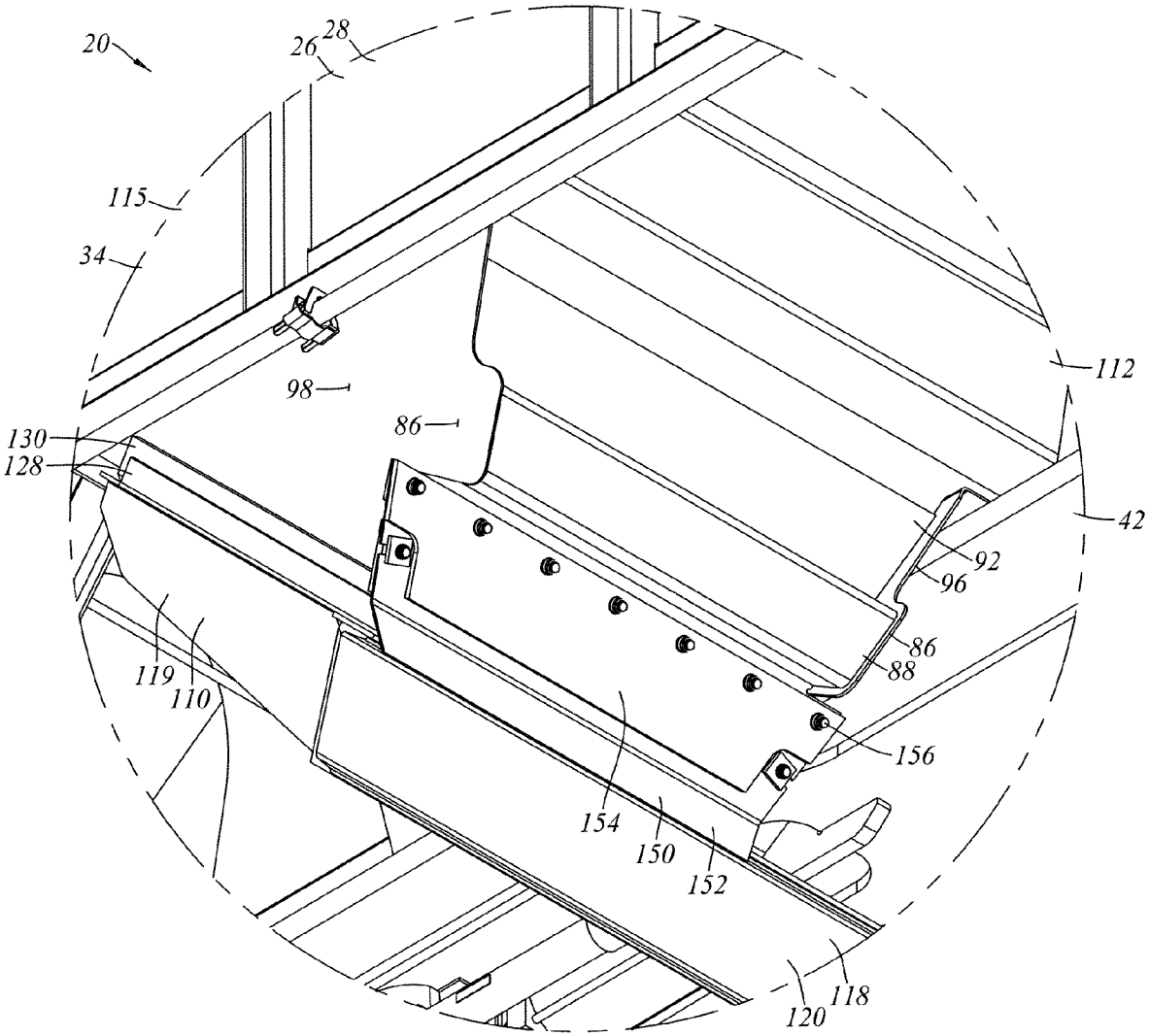
FIG. 3*e* shows an isometric view of the discharge assembly of FIG. 3*a* from below, outboard, and behind a fixed hopper discharge slope sheet.
Figure 3F:
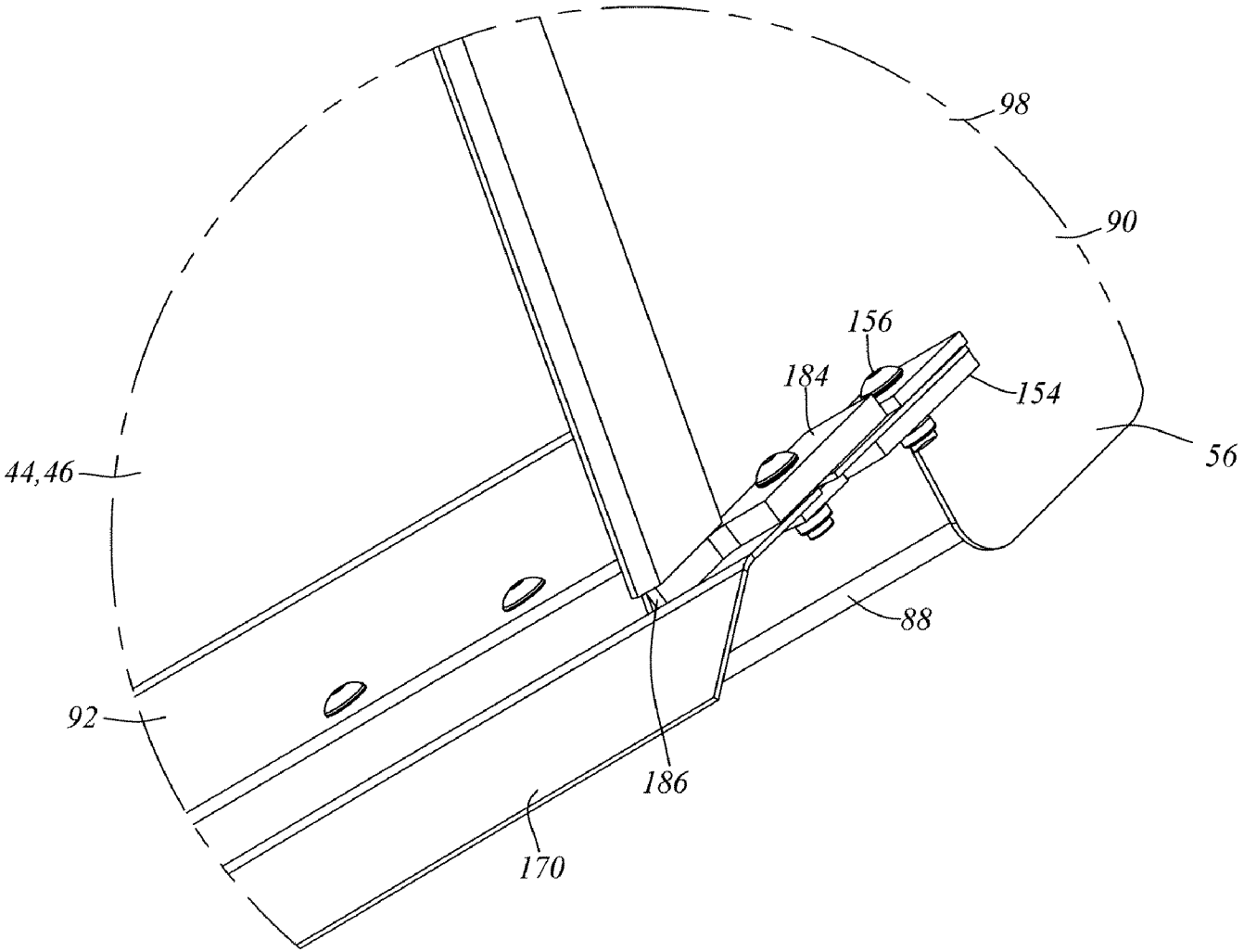
FIG. 3*f* shows a detail of a lip of the discharge assembly of FIG. 3*a* as seen with the movable door in an open condition.
Figure 3G:
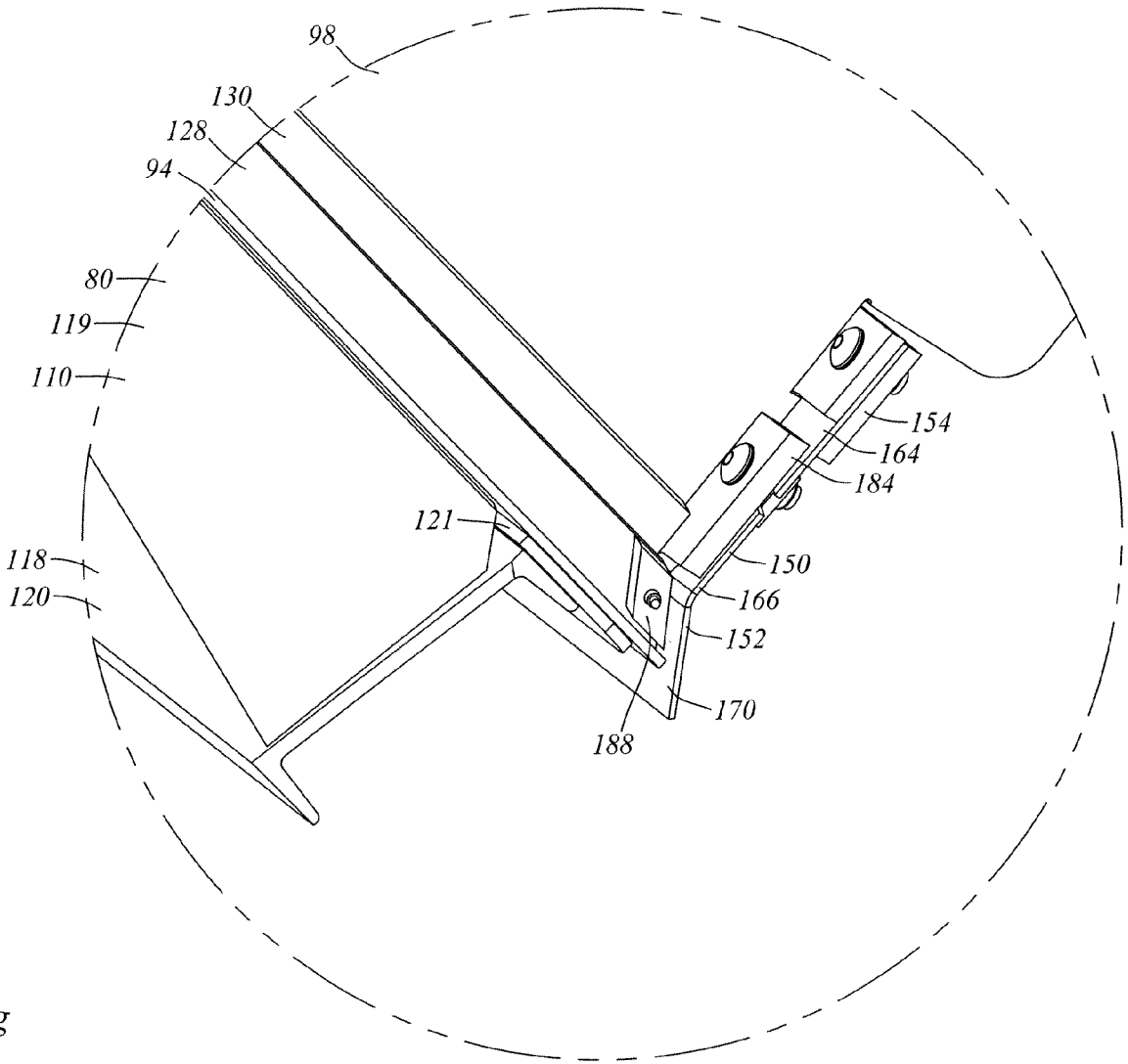
FIG. 3*g* shows a similar detail of the lip in a closed condition.
Figure 3H:
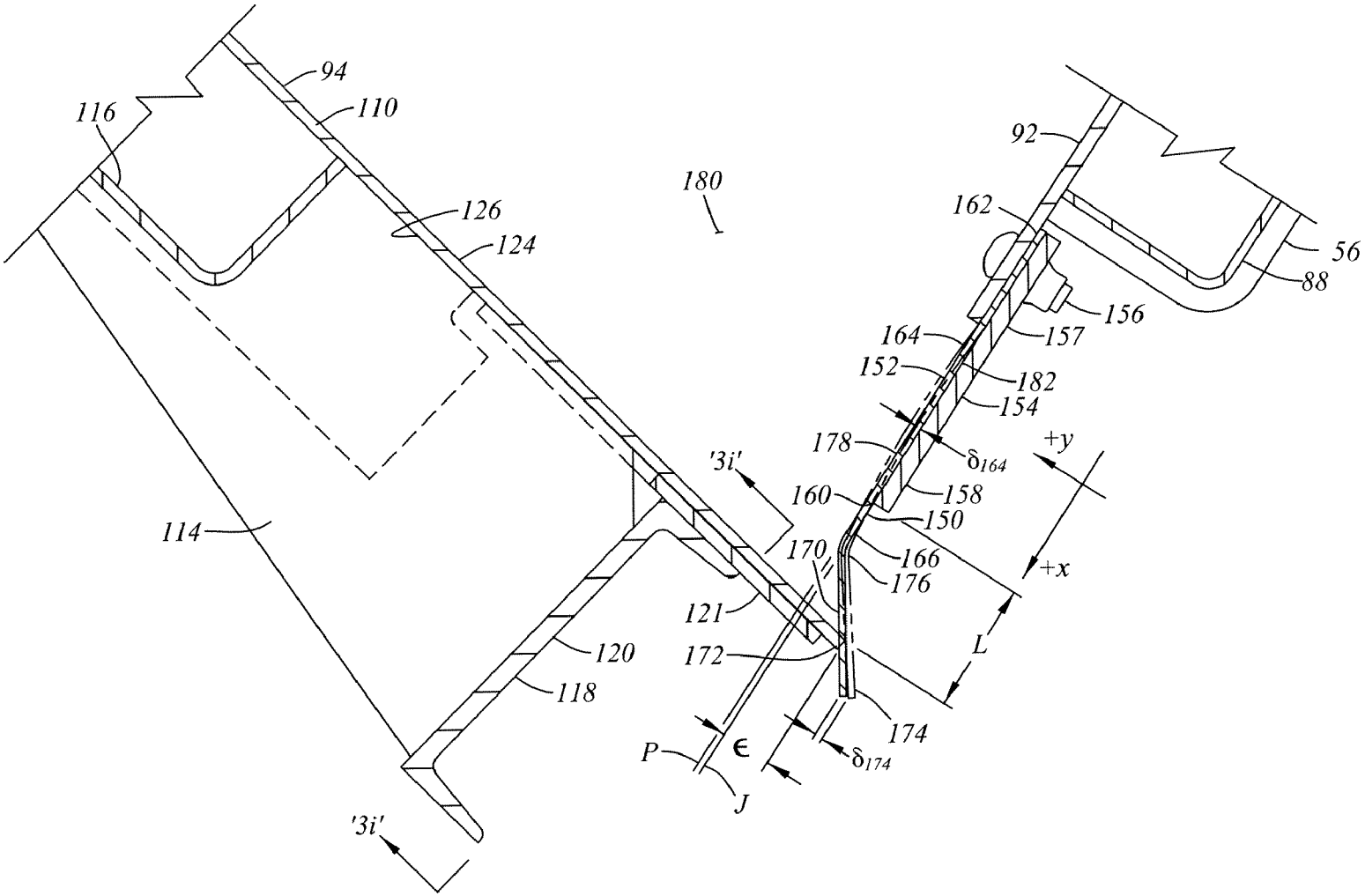
FIG. 3*h* is a detail of a section of the gate of FIG. 3*a;*
Figure 3I:
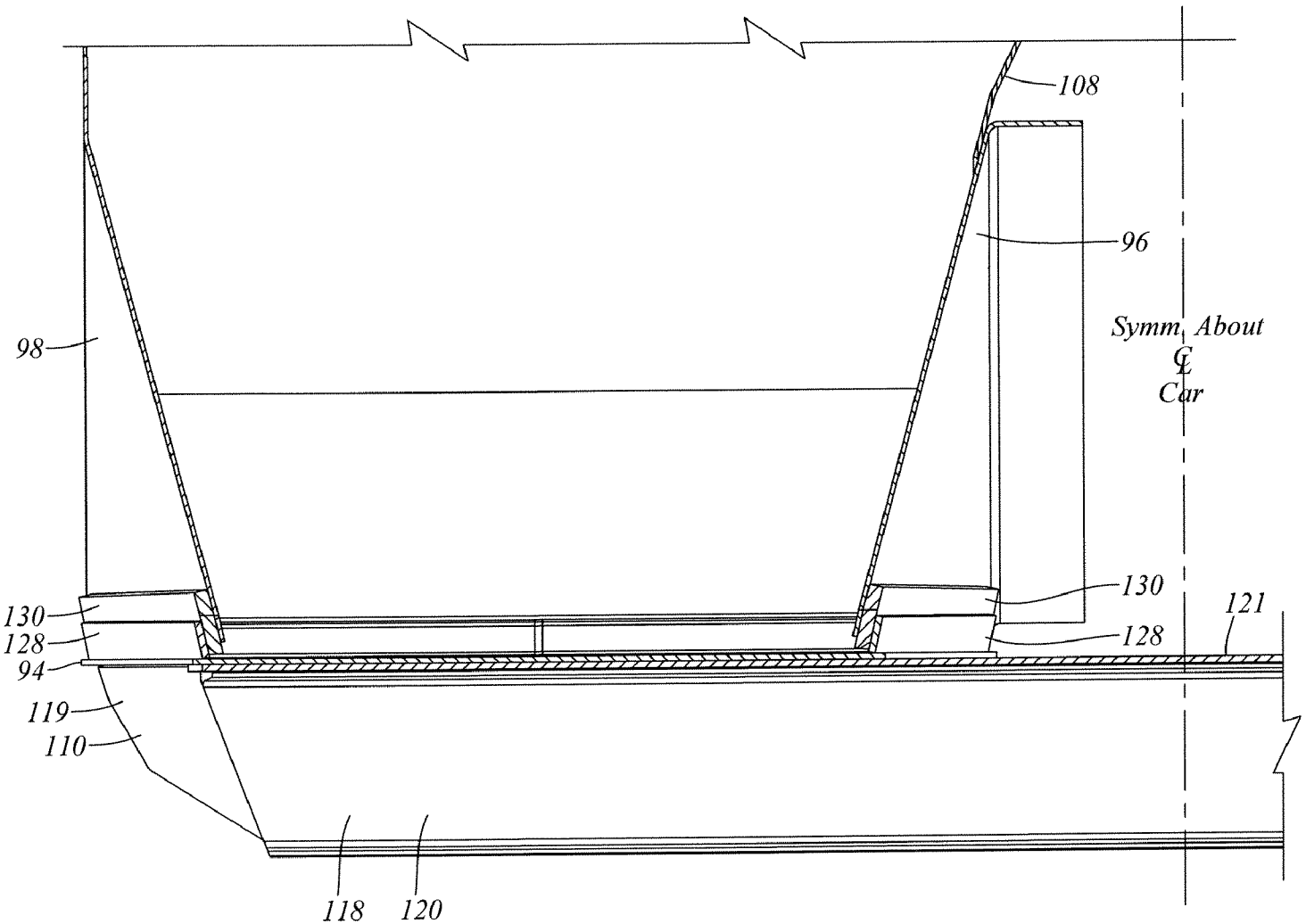
FIG. 3*i* is a detail of the door of FIG. 3*c* taken on section '3*i*-3*i*' of FIG. 3*h;*
Figure 4A:
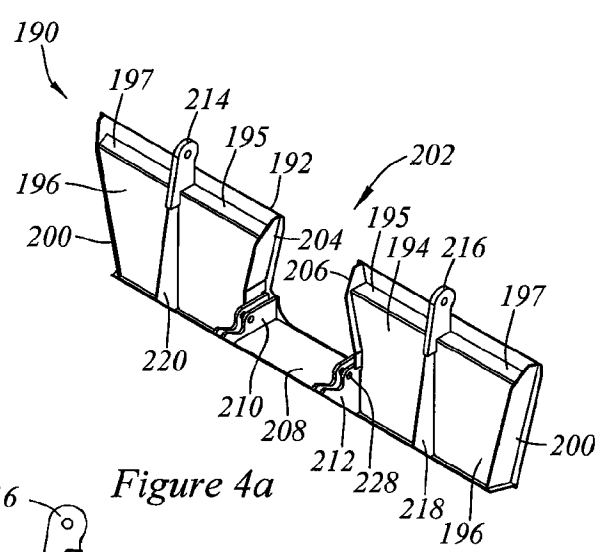
FIG. 4*a* shows an isometric view of an alternate door assembly to that of the gate of FIG. 3*a;*
Figure 4E:
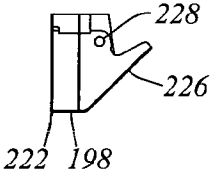
FIG. 4*e* shows a sectional view of the door assembly of FIG. 4*a* taken on section '4*e*-4*e*' of FIG. 4*b;*
Figure 4D:
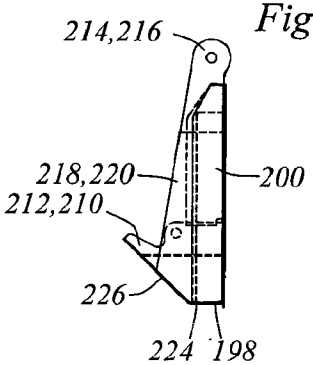
FIG. 4*d* shows a side view of the door assembly of FIG. 4*a;*
Figure 4C:
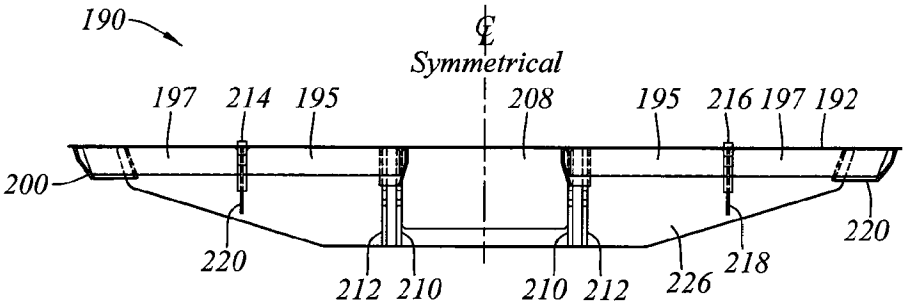
FIG. 4*c* shows a top view of the door assembly of FIG. 4*a;*
Figure 4B:
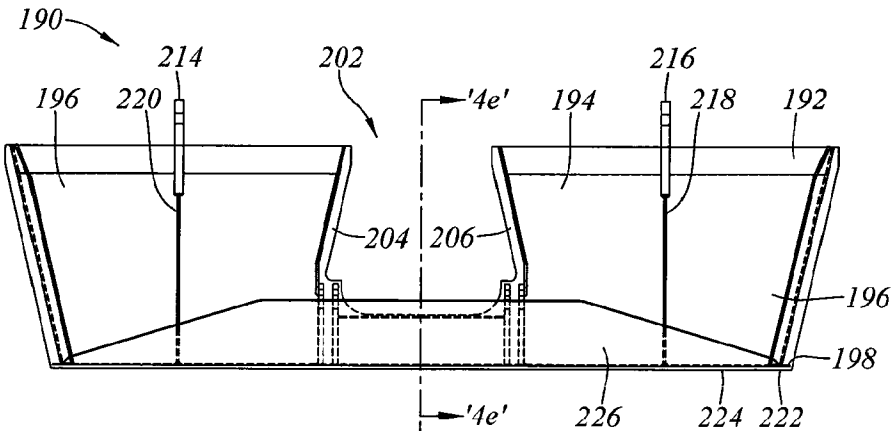
FIG. 4*b* shows a plan view, from in front, of the door assembly of FIG. 4*a;*

The front or forward facing surface 124, or face of the panel or door sheet, or pan defined by extension 94, may, in one context, be defined in terms of facing toward the interior of the volume of the hopper, or in a direction facing toward the lading, or toward the opposed members of the hopper discharge assembly in either the closed or the open position. The back or rear face 126 of the door sheet will not tend to face inwardly with respect to the hopper, the lading or the discharge assembly under either the open or closed positions of the door. The front, or upward, or inward facing surface 124, however, will tend, in general, to face inwardly toward the lading. Door assembly 110 may include upstanding lips, or cheeks, or legs, such as sidewall members 128, that stand proud of the inwardly facing surface of the door. The root of members 128 may lie directly over the mating webs of the gussets, namely items 117 and 119 (FIG. 3*e*). When the mating moving and stationary portions of the discharge assembly come together, members 128 may tend to seat against the opposed lateral cheek, rim or lip, such as may be defined by a backing plate, or bar 130 welded to one or the other of items 96, 98 (FIGS. 3*b*, 3*g*, 3*i*).

The door assembly 110 is drivable between open and closed conditions by an operating mechanism, indicated generally as 140. This mechanism may include a driven shaft 134, a crank arm 136, and a link arm 138. The outer end of shaft 134 is supported by support arm 133 depending from cross member 112 of body 22. Link arm 138 may be of adjustable length, typically a device having a left hand thread at one end, and a right hand thread at the other, such that turning the barrel adjusts the length, at which point the device is secured, whether with locknuts, or wired locknuts, or by some other means. In any case, the link arm is adjustable on fit up when the door is installed and assembled. Door arm crank 136 may include an over-center stop 135, such that when crank arm 136 and link arm 138 are moved to an over-center condition, (e.g., when the door is in a closed condition), and lading bears against the door, the crank and link may tend to be forced to a secured, closed position, rather than tending to creep to an open position such as may have a greater tendency to permit lading to leak. The entire arm assembly may be driven by a motive apparatus, which may include a pneumatic ram 142, connected to a crank arm, clevis or double crank arm, 144, and mounted under center sill 42.

In one embodiment, the movable door assemblies 110 of adjacent discharge sections on either side of center sill 42 may be connected to a common shaft 134 driven by the motive apparatus. Double crank arm 144 may be rigidly mounted centrally to shaft 134 and may function as an input lever to provide torque thereto. The output levers, namely crank arms 136, may also be rigidly mounted to shaft 134. The ends of connecting rods or links arms 138 are mounted in a clevis formed in two webs 137, 139, that embrace the inboard rear face reinforcement, item 117, of the door panel namely extension 94 at its junction with the distal reinforcement channel section 120.

A seal or seal assembly 150 may be mounted along the distal edge of slope sheet extension 92. Seal assembly 150 may include a door seal member 152 having one or more fittings, such as through holes, by which member 152 may be attached to slope sheet extension 92. The uppermost, or proximal margin of member 152 may be trapped between extension 92 and another member, which may be a reinforcement or backing, such as a backing plate 154, that may run laterally across the back of extension 92, near the lower margin of extension 92. Fasteners 156, which may be threaded fasteners, or fasteners that involve plastic deformation or clinching, such as Huck™ bolts or rivets, may be used to secure the backing or reinforcement, and hence seal member 152, in place. The fasteners may be pan head fasteners. In general it may be that the design may seek to minimize the extent to which downstream features stand proud of the plane P of extension 92, (i.e., the plane of the discharge slope) such as might otherwise present loci at which particulate may catch and build up rather than slide.

Backing plate 154 may overlap the lower margin of extension 92, such that a proximal portion 157 backs extension 92, and a distal portion 158 extends in an inclined manner generally downward, predominantly in the direction of the slope of extension 92.

Distal portion 158 may have (when installed) a lowermost margin 160, which may also provide a contact for the back, or downward side, of seal member 152.

Seal member 152 may include a first margin, which may be called a proximal margin 162, that is clamped by blacking plate 154 to extension 92. Seal member 152 may also include a first portion 164, which may be termed a proximal portion, that overlies backing plate 154. Seal member 152 may include a second portion, 166, that may be a distal portion, that may be cantilevered beyond lowermost margin 160 of backing plate 154. Second portion 166 may include a land, 170, against which the opposing closure member may bear when the moving and stationary parts of the door are brought together. In one embodiment, it may be the most distal, laterally extending margin or lip 172 of door assembly 110 that contacts, and deflects, land 170. It may be that land 170 is a surface of second portion 166 that faces generally toward lip 172, and the distal margin 174 of second portion 166 may be bent, as at 176 to orient land 170 in such a manner as may tend to present that surface in an orientation generally perpendicular, or more nearly perpendicular than otherwise, to the motion of lip 172 on closing. Seal member 152 may be thought of as having a first face 178 that faces generally toward, or into the volume of the hopper space 180, and, when the car is loaded, toward the lading. It may be that most of this surface faces at a somewhat upwardly angle. Seal member 152 may also have another surface, 182, which may be termed the back or downward facing surface, which may, in the undeflected condition, tend to lie against backing plate 154.

Seal member 152 may be considered to be a spring, i.e., an elastic energy storage device. When the opposed interface surface, or contact, e.g., lip 172, engages land 170, that motion may tend to urge land 170 to the deflected position $\delta_{174}$ shown in phantom lines in FIG. 3*h*. In so doing, seal member 152 is flexed against the contact point, or fulcrum, defined by the lowermost margin 160 of backing plate 154. The bending moment tends to flex first portion 164 away from backing plate 154 as suggested by the reactive displacement identified by $\delta_{164}$. When the door opens again, seal member 152 may tend to release, and to move back to its former undeflected position. When the door assembly is once more in the closed condition, seal member 152 may again flex as discussed above. When lading is retained in car 20, in whichever hopper may be employed, the weight of the lading may tend to bear against first portion 164, and may tend to urge first portion 164 toward, or against, backing plate 154. In doing this, land 170 may tend to be urged all the more tightly against lip 172, which may, in turn, tend to discourage the leakage of lading. As a matter of terminology, a fulcrum may tend to approximate a point or line contact about which the lever arm pivots or rotates. To the extent that the fulcrum is not a perfectly sharp point, but may have a radius, there may also be rocking action, to a greater or lesser extent, and, for a sufficiently large radius, the motion may be considered that of a rocker. In either case, the relationship is of a lever that, if pushed down on one side, rises on the other.

Side blocks 184 (FIGS. 3*f* and 3*g*) may be mounted at the lateral edges of first portion 164 to discourage sideways migration of lading past the side edges of seal member 152.

Side blocks 184 may include an extending finger 186 that opposes and may abut the lower margin of extension 94 when the moving and stationary portions of the assembly come together. In a further optional feature, it may be helpful when the lading includes magnetizable materials, be it iron ore or concentrate, to employ a magnet such as magnet 188, near the door closure as seen in FIG. 3*g*. Magnet 188 may be a rare earth magnet, and may be mounted close to, or at, the corner of the opening, i.e., adjacent to the lateral end of the seal member, when the side and transverse edges of the door may meet, and where there may be a small gap. The presence of magnet 188 may tend to attract iron filings (or filings of such other lading material as may be) to obstruct such gap, or crack, or opening in the vicinity of magnet 188.

Seal member 152, or analogous structure, could be mounted on the moving door member, and the stationary door member could have a lip analogous to lip 172; or alternatively, seal members could be placed on both sides of the closure interface, although this might perhaps seem redundant in some instances. In each of these alternatives, there is relative motion of the moving and stationary portions of the door assembly between open and closed conditions, such that discharge assembly 90 governs the retention and outflow of lading. At the coming together of the door components, mutual engagement of the one with the other causes elastic deflection of an energy storage device. The elastic deflection, may involve flexing a seal member in the manner of flexing a beam, and may include flexing the beam member over a contact, or rocker, or fulcrum. Inasmuch as the flexing may be toward, or may include a component of displacement toward, the lading, or the space that the lading would normally occupy, the introduction of lading into the lading containment structure may tend to result in lading bearing against the flexed seal member, with the tendency to cause that seal member to seal more tightly than otherwise.

In the alternative embodiment of FIGS. 4*a*-4*e*, the movable closure member, or door assembly of the apparatus of FIGS. 3*a*-3*h* is replaced by a movable door assembly 190. Door assembly 190 may include a first, or front sheet, 192, central, or inboard, and outboard back panels 194, 196, a proximal or back closing member, or members 195 or 197 and a distal or front closing member 198, those items being mounted in co-operative fashion to form a closed box section. The box section may be closed at its laterally outboard ends by webs such as may be in the nature of closure plates 200. Door assembly 190 may have a central rebate or accommodation 202 such as may seat about the center sill. The inboard portions of the box section are closed about the periphery of accommodation 202 by webs such as may be identified as side members or cheek plates 204, 206 that extend predominantly radially with respect to the axis or rotation of the door, and a closure plate 208 that extends predominantly longitudinally, and co-operates therewith to form a generally U-shaped peripheral wall. Left and right hand pairs of driven lug gussets 210, 212 are mounted to either side of accommodation 202 and closure plate 208, and extend from respective cheek plates 204, 206 to front sheet 192 and front closing member 198. Door assembly 190 may also include hinge lugs 214, 216 and lug extension webs 218, 220 that extend radially from lugs 214, 216 and provide a shear web linkage between front sheet 192, back panels 194, 196, front closing member 198, and, in co-operation with lug 214 or 216 as may be, with back closing members 195 or 197. On assembly, side closing members such as items 128 and 130 may be located on trial installation, and welded in place according to the actual fit-up of the door.

Front or distal closing member 198 may have the form of a bent plate that has a first margin abutting the back of front sheet 192 at a location near or adjacent to the distal margin 222 of front sheet 192. In one embodiment, it may meet just shy of the lip, both on the distal edge and laterally. Closing member 198 may also include a first portion 224 such as may tend to be generally perpendicular to, and such as may abut, member 198, and an extension, or skirt 226 such as may extend away from member 198. Skirt 226 may extend rearwardly at an angle, and may run along the conforming margins of double shear lug gussets 210, 212 and hinge lug gussets extension webs 218, 220. Skirt 226 may tend to be of greatest depth in the region of double shear lug gussets 210, 212, and may diminish in size toward the laterally outboard extremities thereof, as on a taper. This may tend to form a reinforced channel along the bottom, or distal edge of the door, and hence to provide a means for spreading loads along that edge, and for transmitting rotational torque received at lug bores 228 all along the distal edge of the door. This embodiment may tend to provide a relatively simple, and yet quite robust structure such as may tend to resist harsh or abusive service.

Figure 5A:
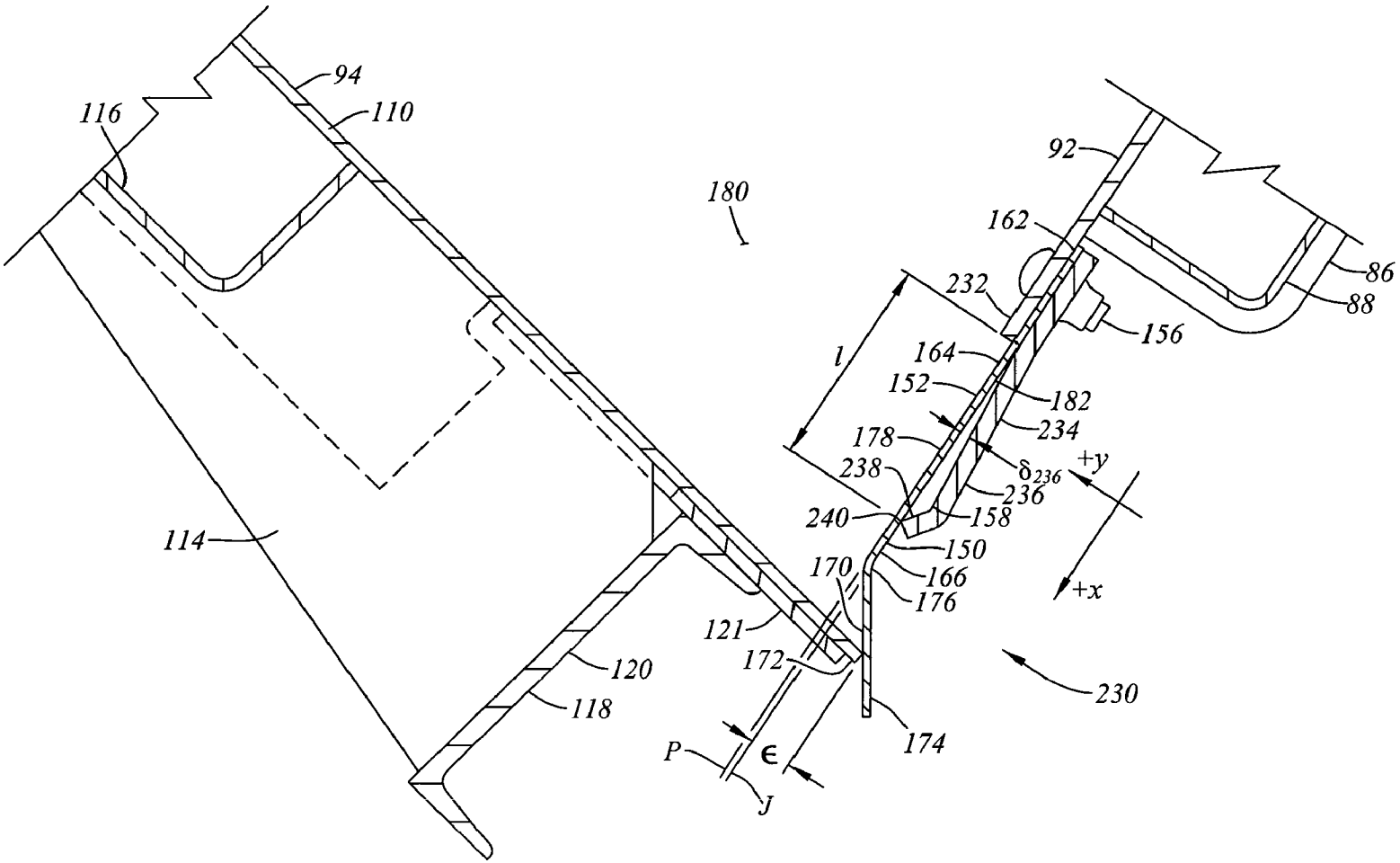
FIG. 5*a* shows a detail of an alternate gate assembly to that of FIG. 3*h;*

FIG. 5*a* shows an alternate embodiment of a gate or door assembly having a seal assembly, indicated generally as 230. It may be taken that the basic structure of the rail road car and the discharge sections is as described above and that seal assembly 230 is similar to seal assembly 150 as described above. A seal member 152 is mounted between a backing member 234 and the distal margin 232 of the slope sheet extension 92. In this case, backing member 234 includes a dog-leg portion 236 that stands outwardly (i.e., generally downwardly) of the plane 'P' of the first portion 164 of seal member 162. Dog leg portion 236 terminates in a return leg 238 having a formed curl, or cusp, or lip, 240, that defines the rocking point or fulcrum against which seal member 152 works when engaged by lip 172. When assembled there may be a gap, $\delta_{236}$ between seal member 152 and dog leg portion 236.

It may be noted that seal member 152 may have its upper margin clamped between the slope sheet extension and backing member (be it 154 or 234) in such as way as to have a built-in end condition at their upper margins. That is, not only is the displacement of the upper margin fixed at zero, but the slope is also fixed at the angle at which the margin is clamped, and deflection implies bending and a bending moment (as opposed to a pin-jointed or hinged connection that can rotate freely). If seal member 152 is thought of as being a beam, which may have a bent end, the major portion of the beam may lie in a plane, when undeflected. Alternatively, a plane J may be constructed along the rearward face of the seal member across the point of tangency against the fulcrum or rocker of the distal margin of the backing plate. The closing action of the gate may tend to yield contact that has a component of motion that may tend to be perpendicular to that plane, and a component of motion that may tend to be parallel to that plane. The perpendicular component will tend to work on a moment arm, L, relative to the pivot or fulcrum point, to flex seal member 152. To the extent that the end of the beam is bent, and the contact occurs out of this plane, the eccentricity of the component parallel to the plane may tend to enhance the tendency of the member to flex, rather as an eccentrically applied load may have an enhanced tendency to urge a column to buckle. This eccentricity, from the plane to the center of contact, is notionally indicated as c.

Figure 5B:
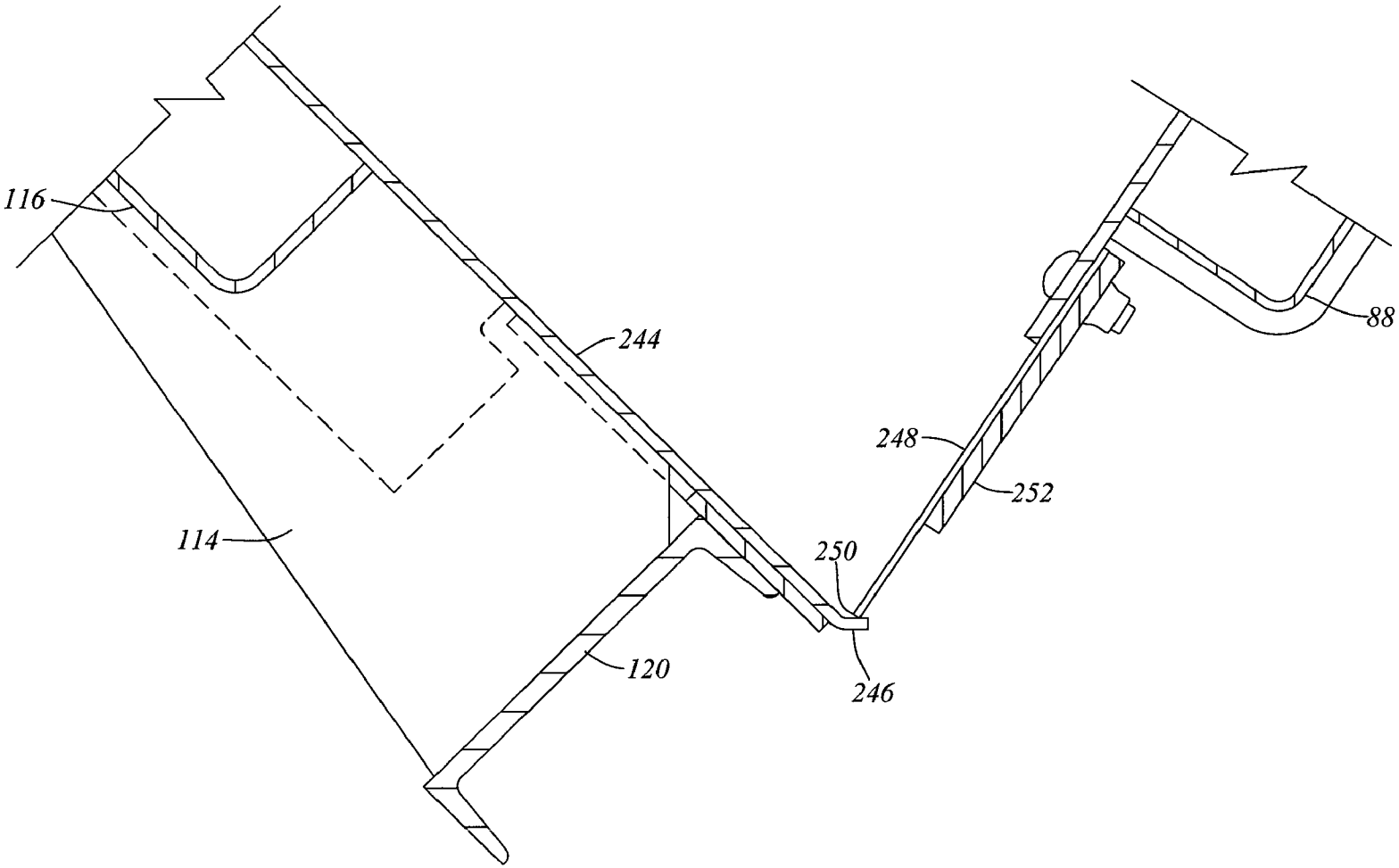
FIG. 5*b* shows a detail of a further alternate gate assembly to that of FIG. 3*h;*

Another alternate embodiment of seal arrangement is shown in FIG. 5*b*. Again, this embodiment is substantially similar to that of FIG. 5*a*, except as noted. In this instance, the slope sheet extension of the movable door member, indicated as 244, incorporates a distal edge lip 246 that is bent in the generally forward (i.e., forward in terms of the direction of motion when the door is closing), or upward direction. The mating, co-operating flexible seal member 248 has a tip 250, that is caught by, and deflected by, engagement of lip 246. This may tend to urge seal member 248 to deflect upwardly, away from backing member 252. Introduction of lading may tend to cause seal member 248 to push more strongly toward backing member 252, and, to the extent that door member 244 is in a fixed and locked position, the mutual engagement of parts may tend to become tighter. In this instance, seal member 248 may not have a bent distal lip, but may have a straight profile.

Figure 5C:
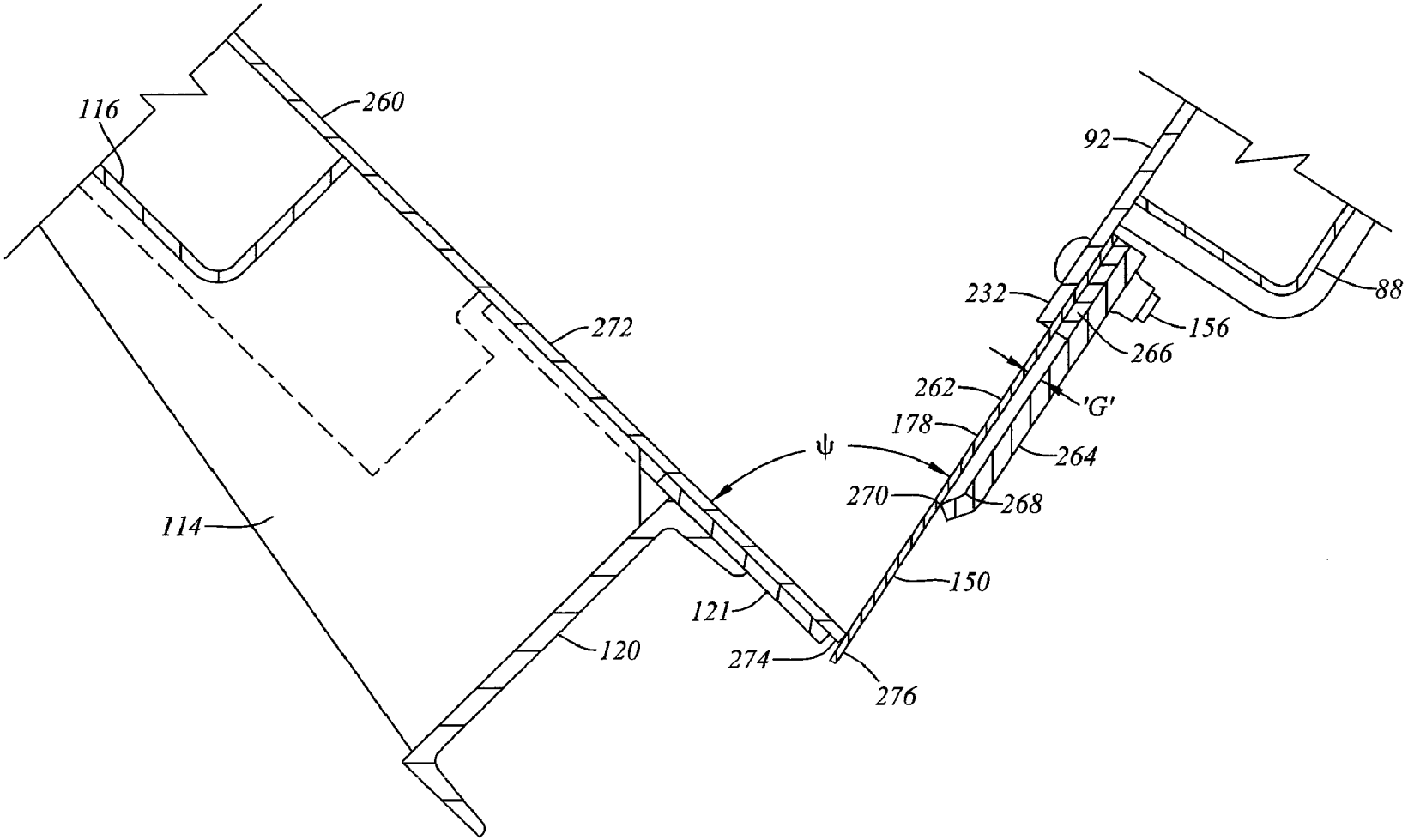
FIG. 5*c* shows still another alternative gate assembly to that of FIG. 3*h;*

Still another embodiment is shown in FIG. 5*c*, the moving door assembly 260 may be substantially the same as door assembly 110. A flexible seal member 262 is mounted to a backing bar 264 that is spaced therefrom by a washer, or spacer or shim 266. The distal end of backing bar 264 may be bent as indicated at 268 to define a fulcrum 270 at the most distant tip. The included angle ψ between the door sheet 272 and the tangent plane of undeflected seal member 262 at the point of contact is less than 90 degrees, such that the tip 274 of door sheet 272 may tend to ride against, and progressively deflect, the cantilevered end portion 276 of seal member 262. As before, introduction of lading into the hopper may tend to cause pressure to be exerted by the lading on seal member 262 between fulcrum 270 and shim 266, such that it may tend to deflect into the gap region 'G' identified between seal member 262 and backing bar 264.

Figure 5D:
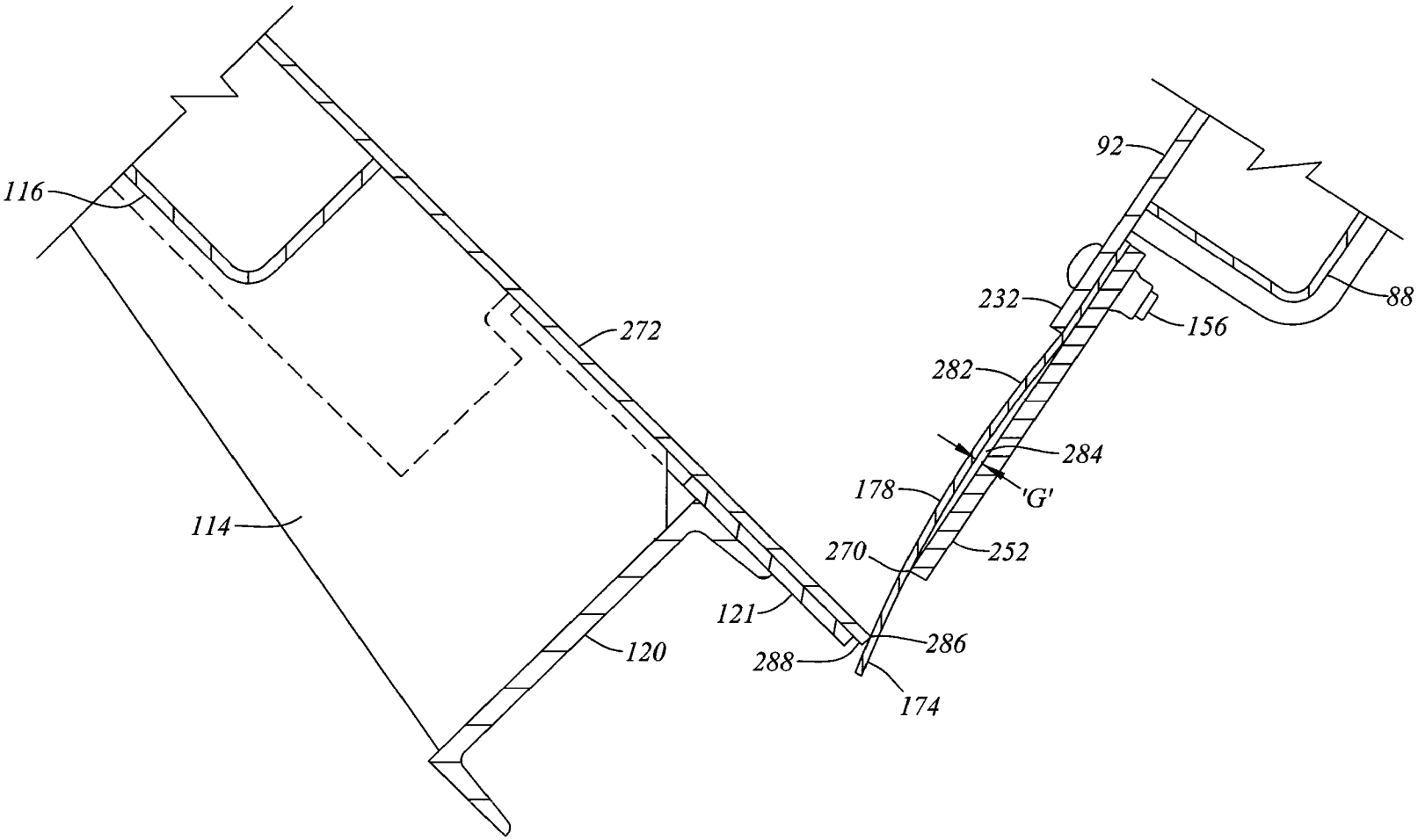
FIG. 5*d* shows yet another alternative gate assembly to that of FIG. 3*h;*

In the similar embodiment of FIG. 5*d*, the seal member 282 is pre-bent on a curve to give a pre-existing gap 284 between the proximal portion of the seal member and the backing bar. The curve is such that at the point of engagement 286 between the distal edge 288 of the moving door sheet and seal member 282 there is a non-perpendicular slope, such that the resultant wedging action as the door is closed may tend to cause greater deflection in seal member 282, increasing its curvature, widening gap 'G', and forcing the distal extremity of seal member 282 in the opposite direction.

Figure 6A:
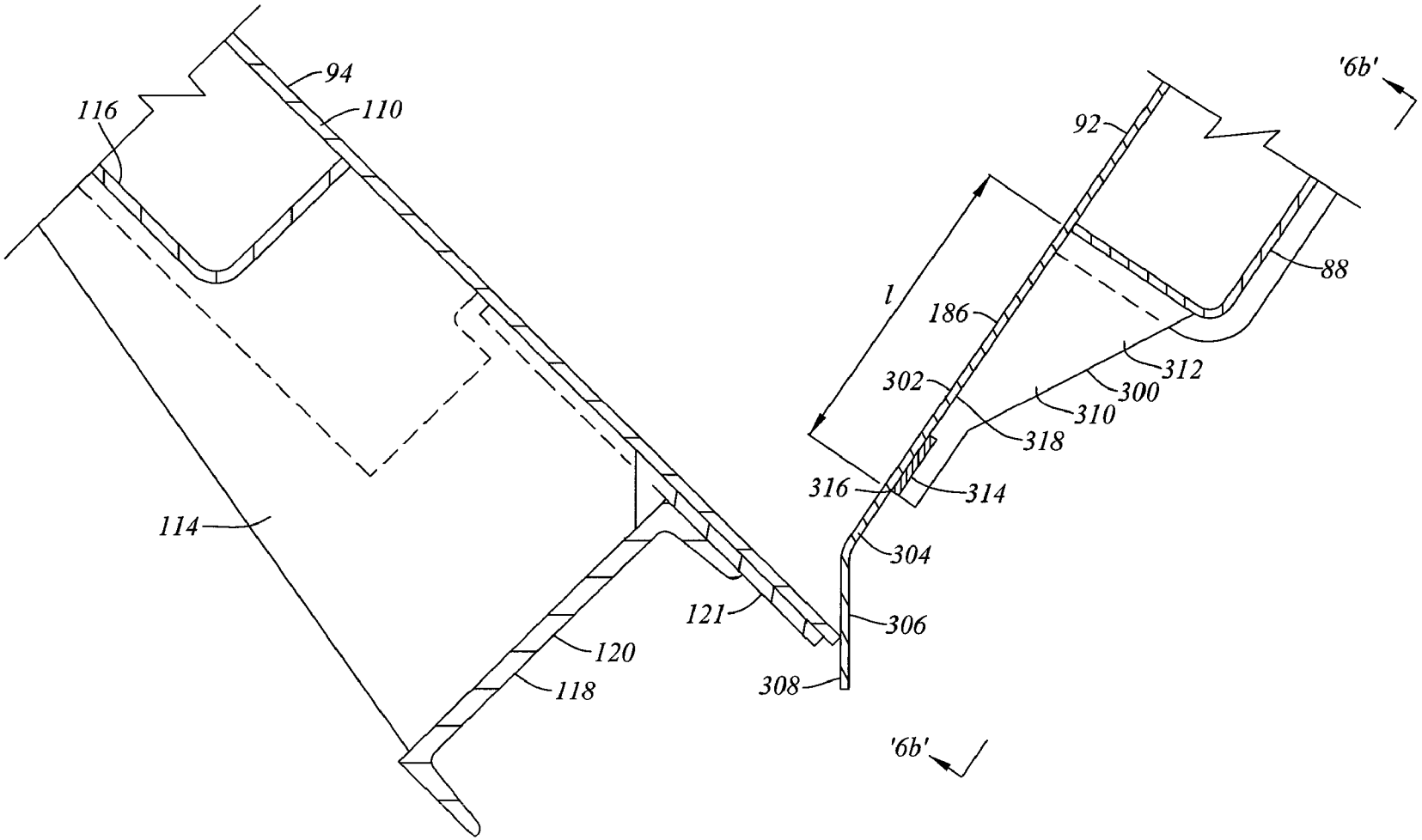
FIG. 6*a* shows a scab isometric view of a portion of an alternate embodiment of gate assembly to that of FIG. 3*a;*
Figure 6B:
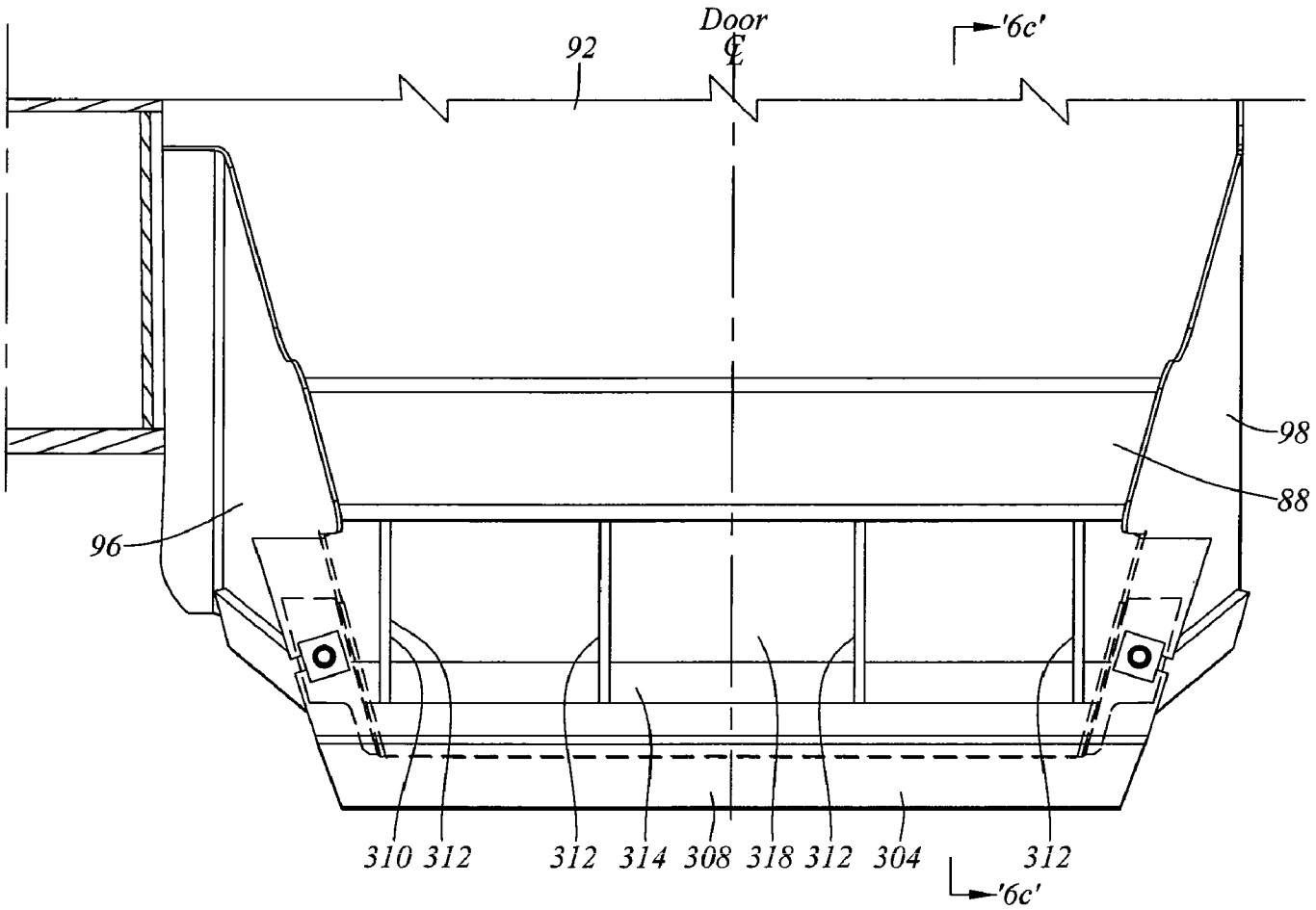
FIG. 6*b* shows a sectional view of the gate assembly of FIG. 6*a*, analogous to the view of FIG. 3*i;*

FIG. 6*a* shows another embodiment of seal assembly, indicated generally as 300. In this embodiment, the first member of the seal assembly may be an extension 302 of the slope sheet, or pan sheet of either the moving or stationary portion of the door, which may be an added plate or an extended margin formed as an integral part of the door pan, or extension sheet. When formed integrally, the need for fasteners such as item 156 identified above, may be obviated. In any case, sheet 92 (or 94, as may be) may have an extended margin, as at 304, which may be integrally formed, and which may include a bent distal portion 306, defining a land 308 for engaging the other closure member when the opposed closure members of the gate are brought together. Assembly 300 may also include a second member in the form of a backing element, or backing member or reinforcement fence assembly 310, that may include an array of arms, or legs, or braces, however they may be termed, identified as 312, which may be in the form of tapered posts having a base or root leg fixed to the closure member lateral reinforcement or tube, namely item 88. The distal portion of the legs may support, and may have a niche, notch, slot, relief or rebate defining an accommodation in which a laterally extending member, such as a reinforcement or backing bar 314 is seated. Backing bar 314 may extend across the full width of the closure member, from side plate to side plate. Backing bar 314 may be fixed in place on braces 312 by such means as mechanical fasteners or welding. In this embodiment, a portion of extended margin 304, lying downslope from reinforcement tube 88, extending over a distance 1, is not permanently secured to either the forward faces of the legs 312 of fence assembly 310, or backing bar 314, but rather may be free to flex. As such, when the distal portion of the seal member is engaged, by pushing on land 308, the inward lower edge 316 of backing bar 314 may act as a fulcrum, and the inner or proximal portion 318 of the first seal member (i.e., the portion of the margin extension lying between fulcrum edge 316 and reinforcement tube 88, may tend to be permitted to flex in a direction that is predominantly inwardly relative to the hopper more generally. As above, when engaged, and the gate is in a closed position, the presence of lading bearing against the flexed portion 318, may tend to urge the distal portion, 308 to bear all the more tightly against the opposing closure member, such as may be.

Figure 6C:
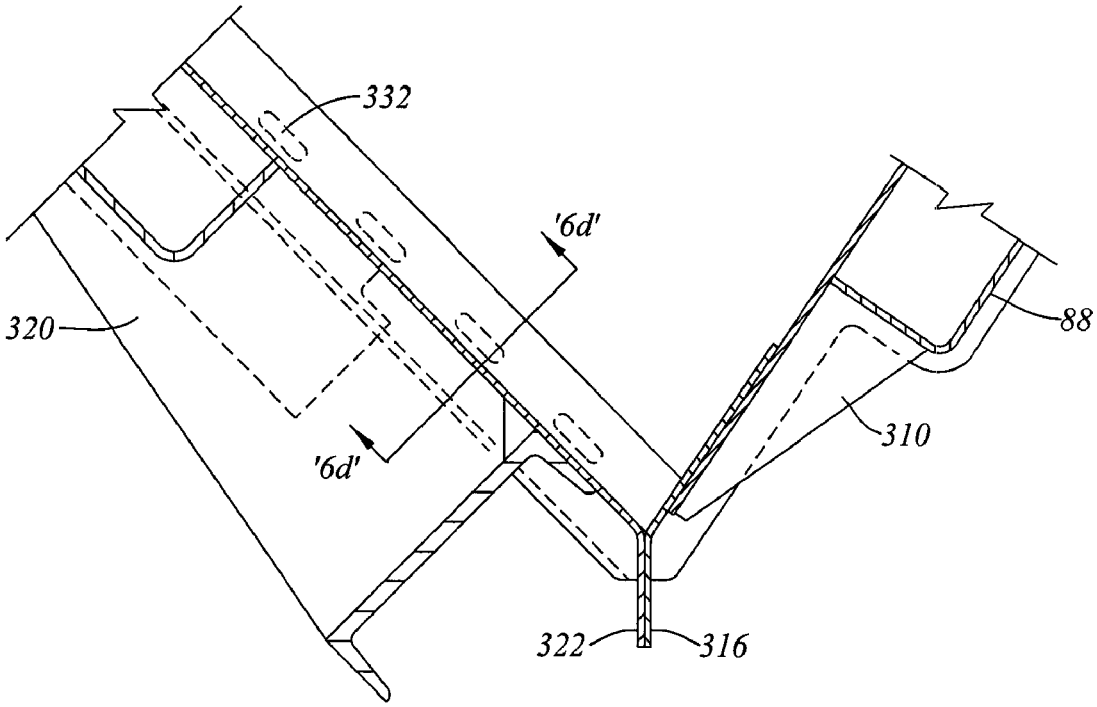
FIG. 6*c* shows a detail of the gate assembly of FIG. 6*a* taken on section '6*c*-6*c*' of FIG. 6*b;*
Figure 6D:
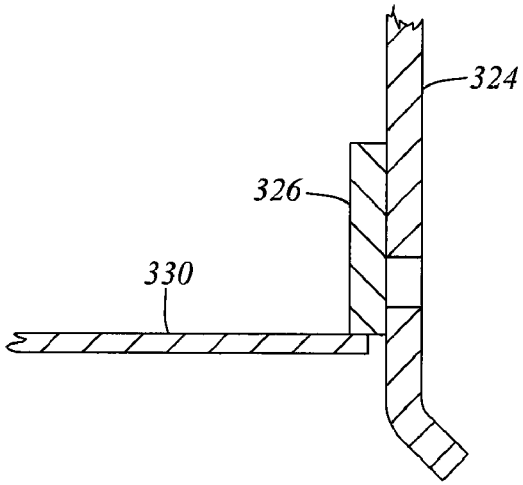
FIG. 6*d* shows a section of an alternate gate assembly to that of FIG. 6*a;*

As shown in FIG. 6*c*, the embodiment of FIG. 6*a* may also include a mating door member 320 that has a bent lip, as indicated at 322. This bent lip may be of a similar flexural nature to the opposing bent lip 316, and, on engagement, either or both may deflect, and form a spring loaded seal. It may also be that the side plates 324 of the chute may be provided with internal stops, or abutments, identified in this instance as seal bars 326, against which the lateral margins of the gate door sheet 330 may engage, and whose ends may oppose, or abut, extension 304 on closure. Those seal bars 326 may be fit up on assembly, and welded in place from outside by means of pre-formed welding access slots 332.

The seal member, be it item 152, 262 or 302, transmits a bending moment across the fulcrum (whether it be called a fulcrum, pivot, rocker, or some other term). Although seal member 152, 262 or 304 may have a bend at the fulcrum, more generally it may tend to be a flat, or straight, beam, and so will also have slope continuity at the fulcrum. Thus the bending moment that deflects the distal portion of the seal member, will also cause flexure in the proximal portion. Assuming a beam, and imposing a Cartesian frame of reference in which the x-axis lies in the plane of the undeflected beam, and the y-axis is perpendicular to the x-axis, and assuming deflections that are relatively small as compared to the length of the beam, deflections of the distal portion that have a component that may be taken as being substantially perpendicular to the initial, undeflected profile of the beam, may be considered to be deflections in the −y direction. When this occurs, the proximal portion of the beam may tend to flex in the opposite, or +y direction. In this sense, it may be said that deflection of the distal portion in one direction yields a flexing of the proximal portion in a reactive, or in some sense, opposite, direction. This may also be expressed in somewhat different terms, taking plane P as a frame of reference. In the open position, that portion of the seal member lying inboard of the lip may tend to lie more or less flat flush with, or perhaps somewhat shy of, plane P of the slope sheet along which the lading may slide during discharge. More generally, all of the seal assembly my lie flush or shy of this plane. However, when the closure members mutually engage, the proximal portion (between the fulcrum and the proximal edge or part of the seal member attached to the slope sheet extension, be it 92 or 94), will tend to flex to a position that is either less shy of the former, un-flexed position relative to plane P, or proud of plane P. Similarly, when lading is then added, and bears upon the flexed portion, it will tend to want to sit down, less proud than in its flexed, but unladed, position.

The seal member, be it item 152, 262 or 304, may be exposed to an abrasive service environment. As such, it may be made of a relatively abrasion resistant material, such as a high yield stress steel. It may be a stainless steel. In various embodiments, the yield stress may be as great or greater than 50 kpsi, 70 kpsi or 100 kpsi. In another embodiment it may be as great or greater than 130 kpsi. In another embodiment, it may be as great or greater than 150 kpsi. It may also be noted that the seal member, be it 152, 262, or 304, may be a replaceable without the need for employing welding or cutting torches. That is, when the part is no longer serviceable, either due to wear or damage, the fasteners can be removed, a new part inserted, new fasteners installed, and then the car may be operated as before.

Figure 7A:
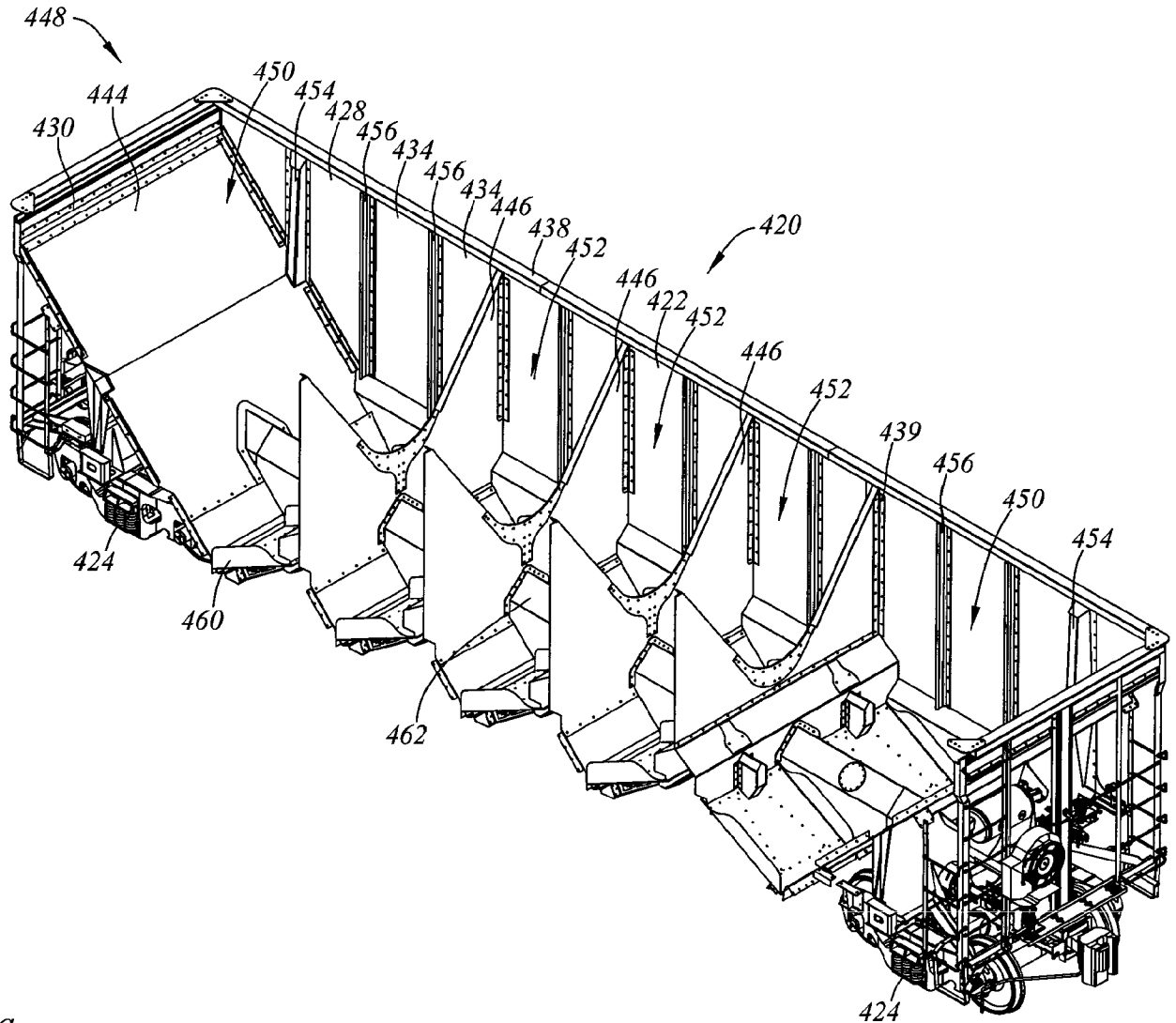
FIG. 7*a* shows an isometric view of an alternate railroad car to that of FIG. 1*a*, the near side beam of the car being removed to reveal internal detail.
Figure 7C:
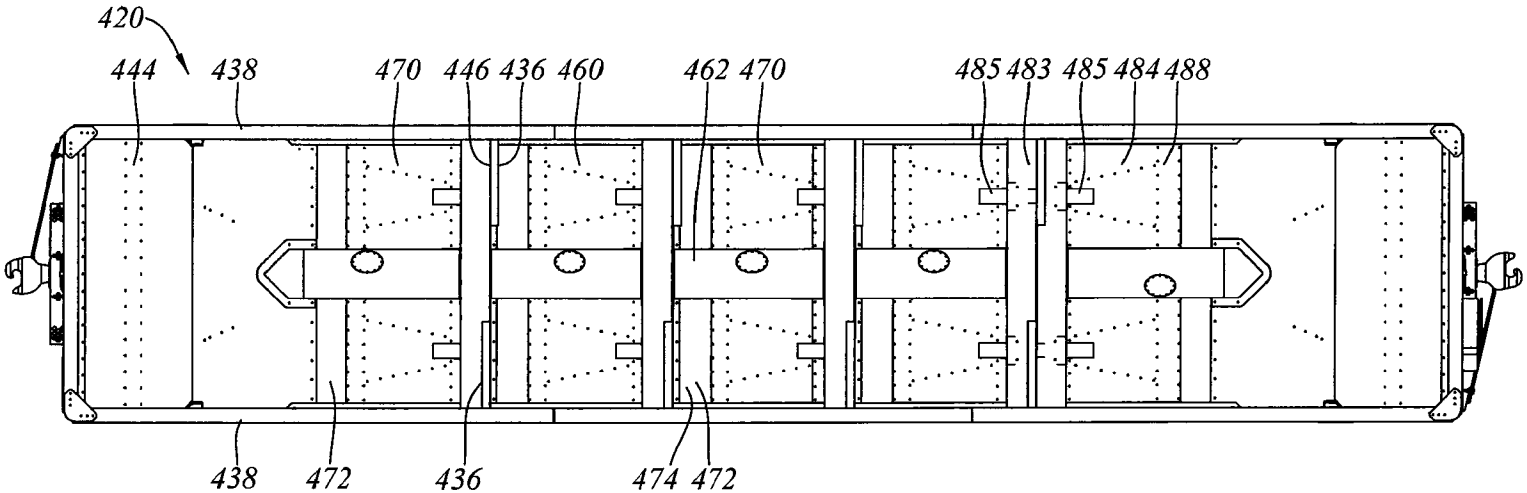
FIG. 7*c* shows a top view of the railroad car of FIG. 7*a;*
Figure 7B:
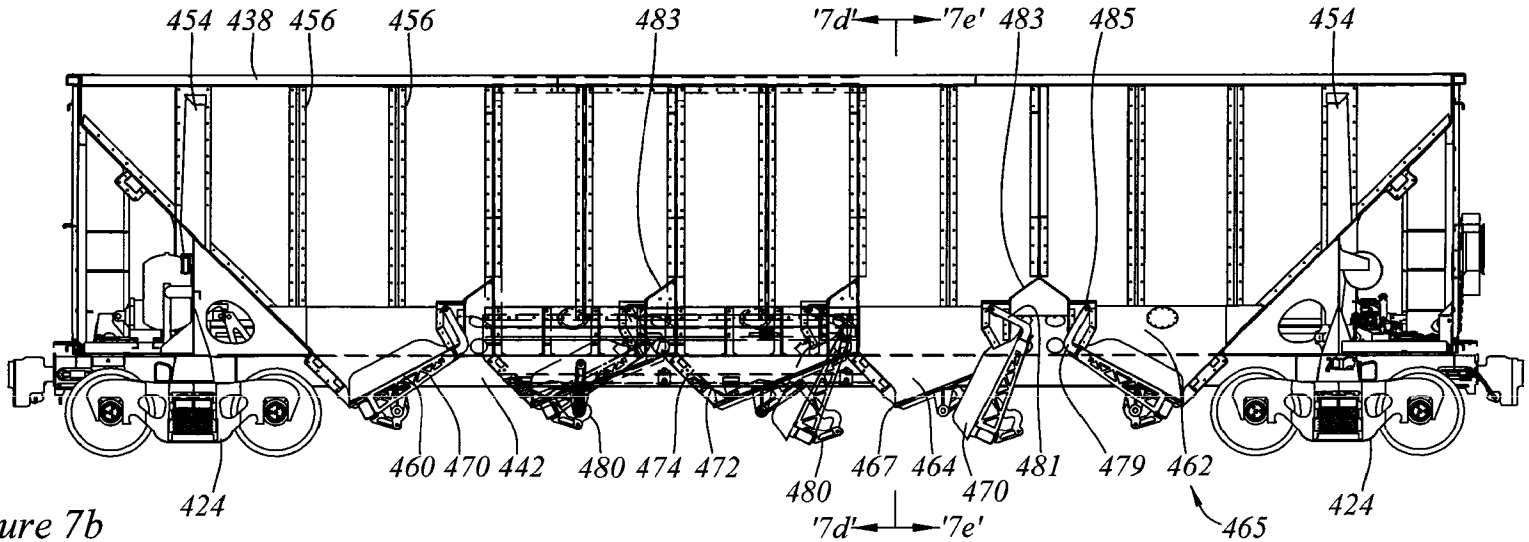
FIG. 7*b* shows a side view of the railroad car of FIG. 7*a* with some portions showing hidden details of a door mechanism.
Figure 7D:
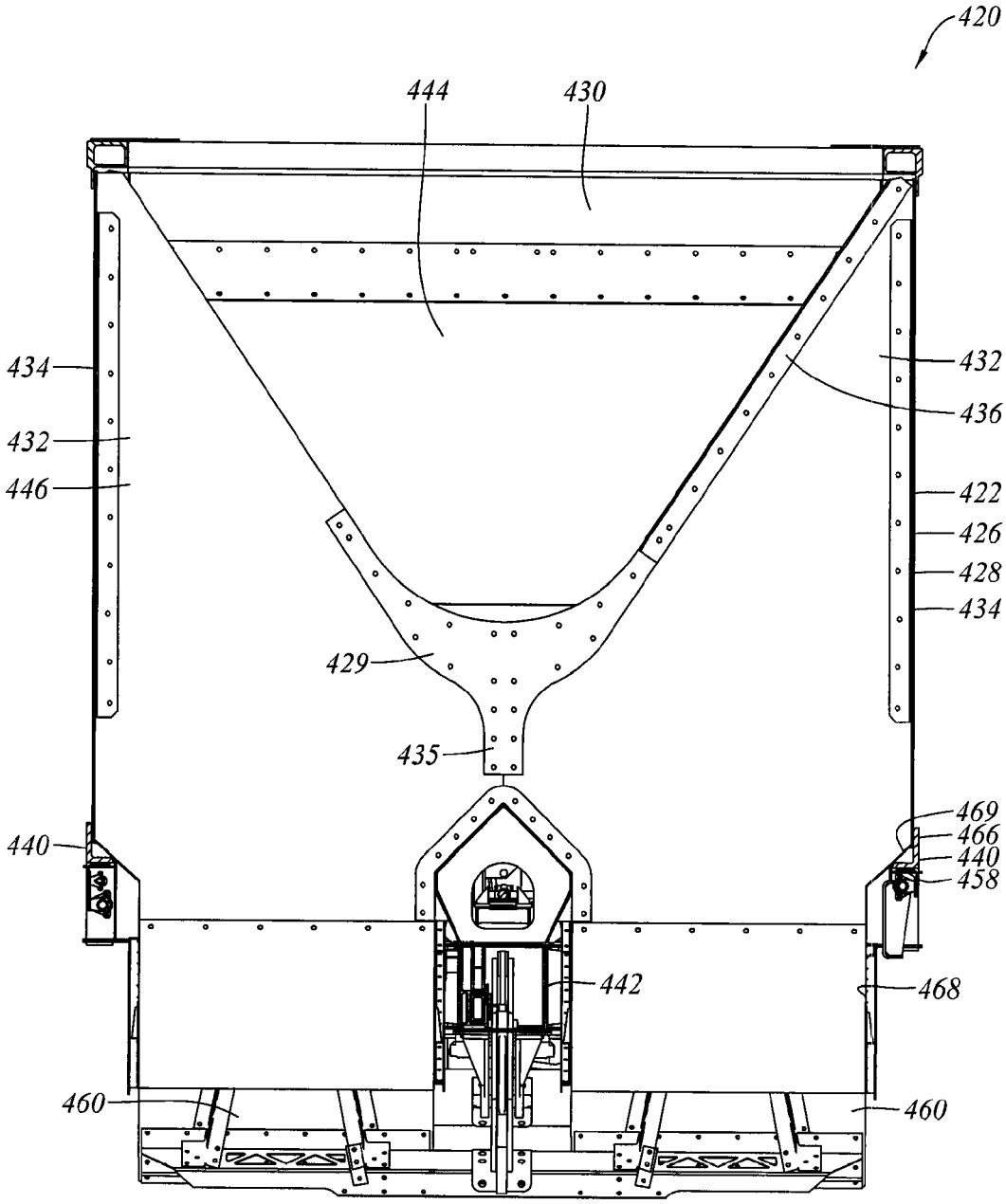
FIG. 7*d* shows a transverse cross-sectional view of the rail road car of FIG. 7*b* taken on section '7*d*-7*d*'.
Figure 7E:
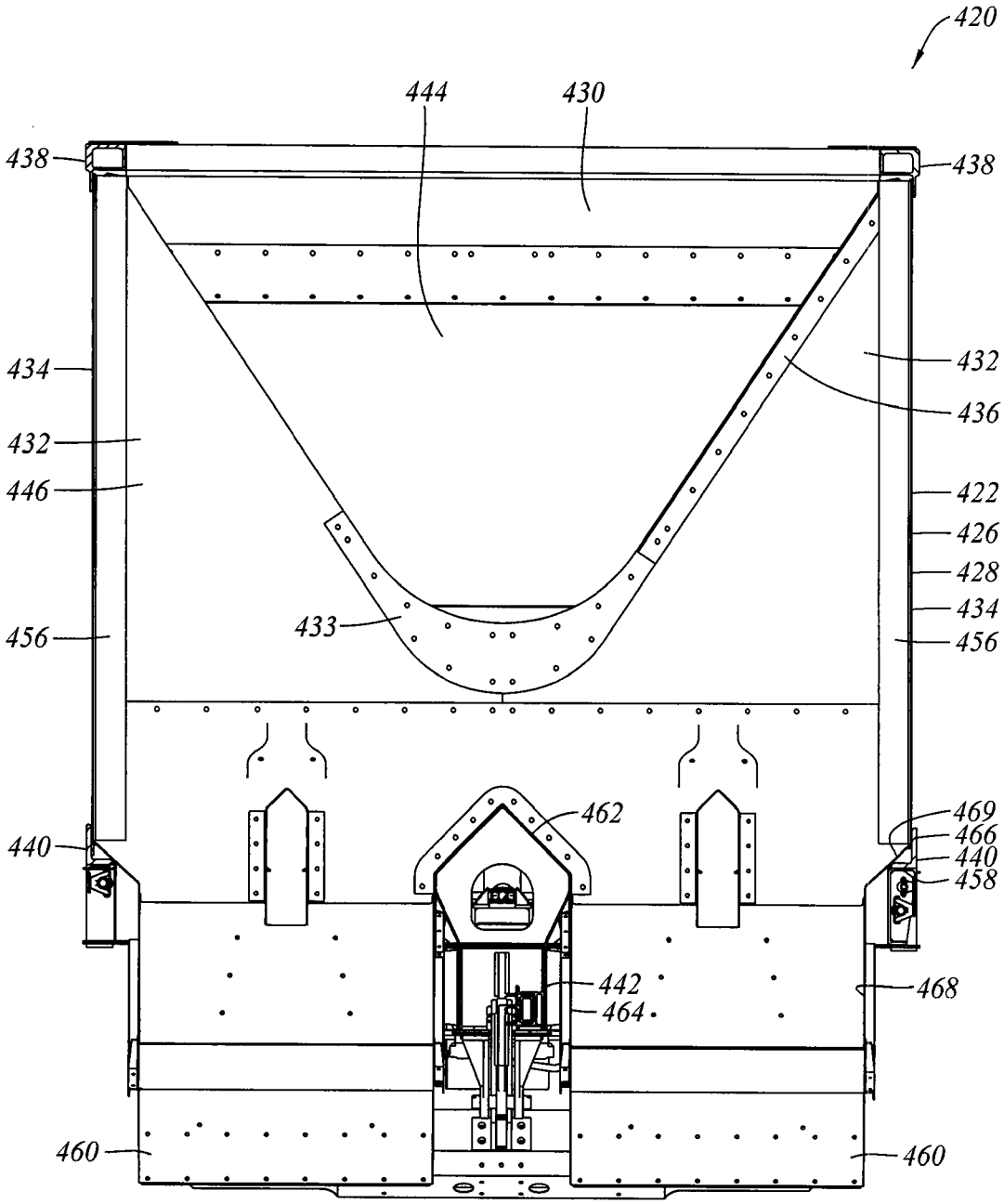
FIG. 7*e* shows a transverse cross-sectional view of the rail road car of FIG. 7*b* taken on section '7*e*-7*e*'.
Figure 7F:
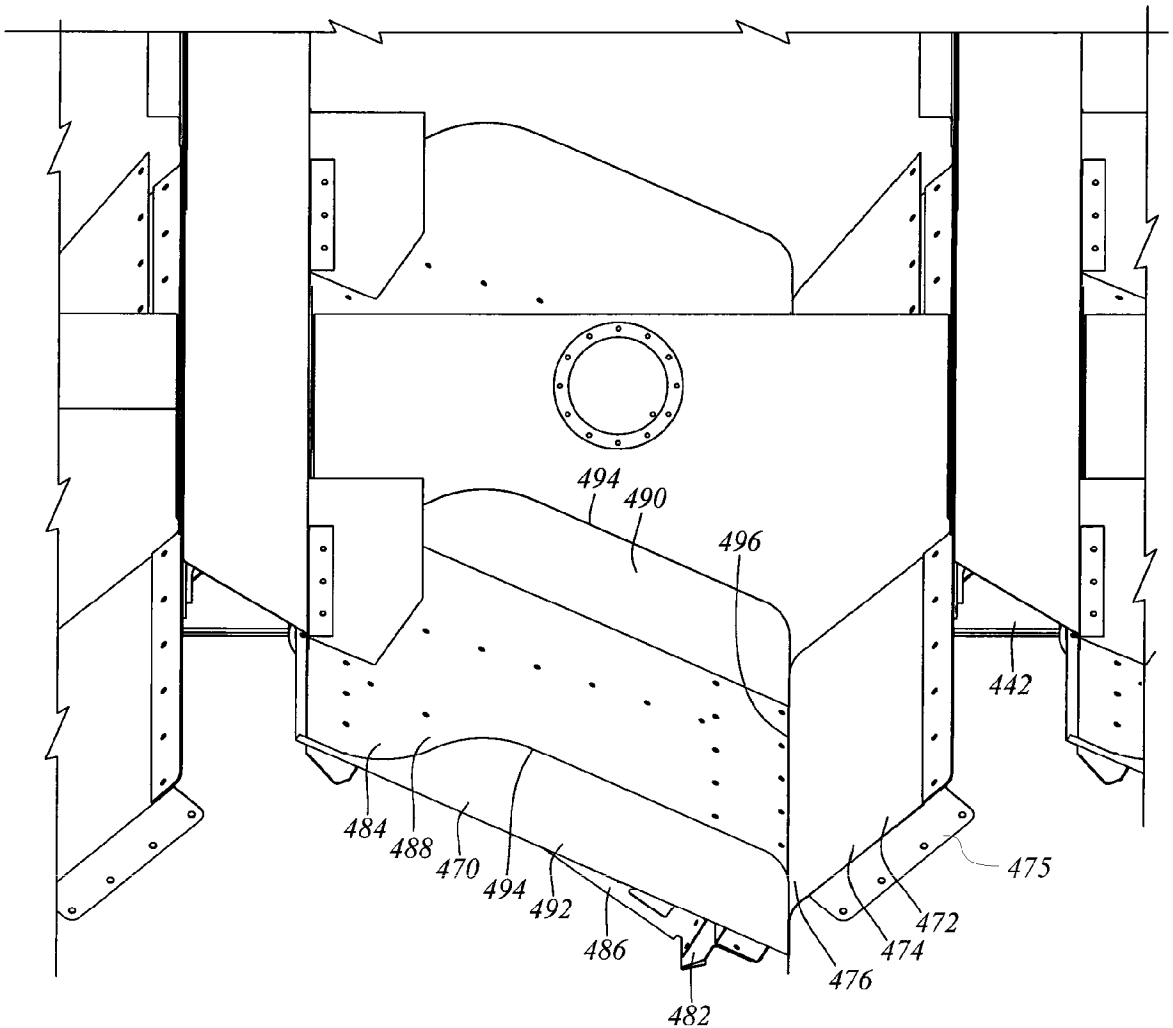
FIG. 7*f* shows a cross-sectional view of the rail road car of FIG. 7*a* with the sidewall removed, and viewed on an angle downwardly and inwardly toward the center sill.
Figure 7G:
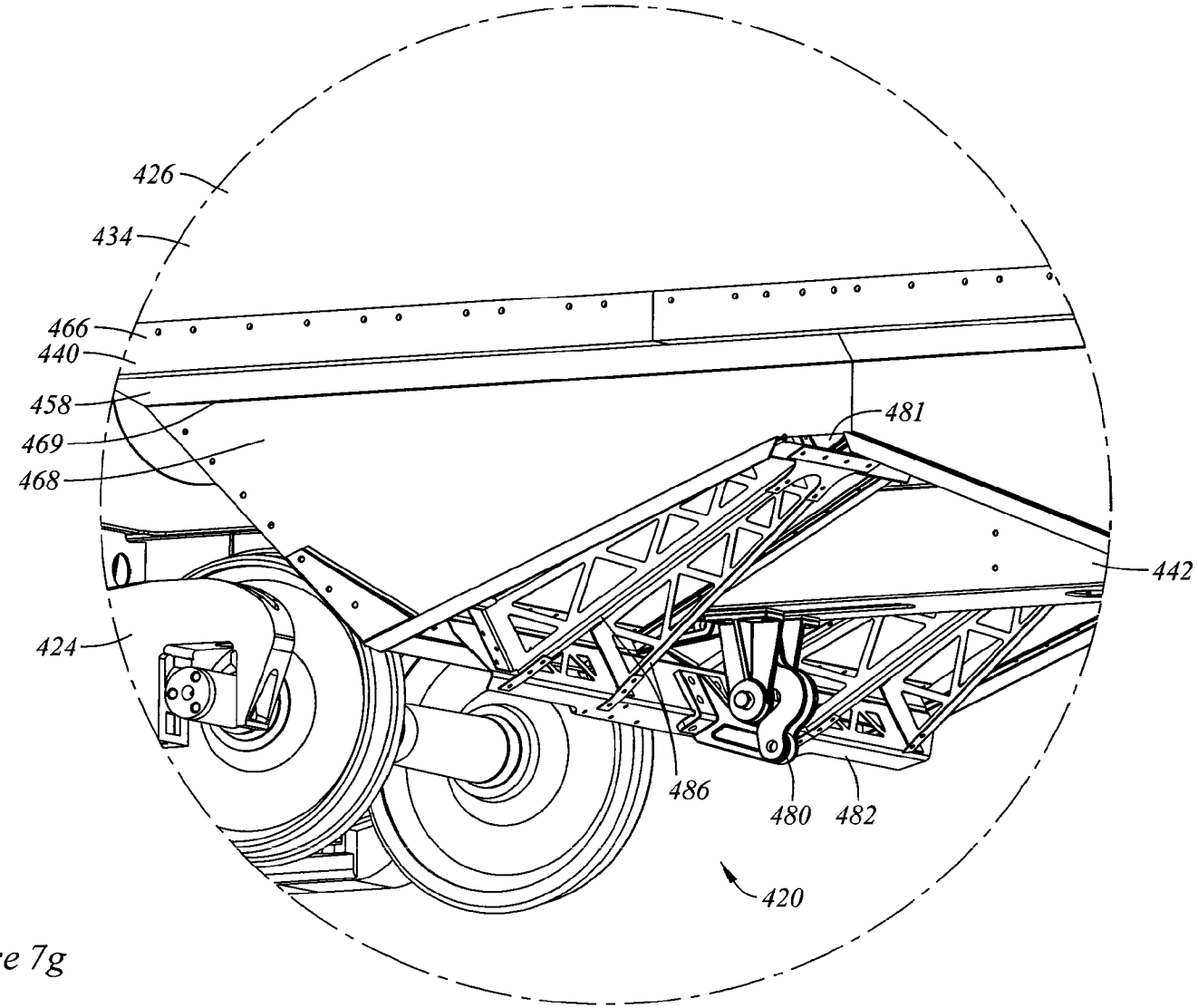
FIG. 7*g* shows a perspective view of a gate assembly of the rail car of FIG. 7*a*, looking on an upward and inboard angle.

FIG. 7*a* shows an isometric view of an alternate example of a rail road freight car 420 that is intended to be representative of a wide range of rail road cars in which the present invention may be incorporated. In this view the near side beam is removed to permit internal features of the car to be seen more easily While car 420 may be suitable for a variety of general purpose uses, it may be taken as being symbolic, and in some ways a generic example of a coal car. Car 420 may be symmetrical about both its longitudinal and transverse, or lateral, centerline axes. Consequently, it will be understood that the car has first and second, left and right hand side beams, bolsters and so on.

By way of a general overview, car 420 may have a car body 422 that is carried on trucks 424 for rolling operation along railroad tracks. Car 420 may be a single unit car, or it may be a multi-unit car having two or more car body units, where the multiple car body units may be connected at an articulated connector, or by draw bars. Car body 422 may have a lading containment vessel or shell 426 such as may include an upstanding wall structure 428 which may have a pair of opposed first and second end walls 430 that extend cross-wise, and a pair of first and second sidewalls 434 that extend lengthwise, the end walls 430 and sidewalls 434 co-operating to define a generally rectangular form of peripheral wall structure 428. Wall structure 428 may include top chords 438 running along the top of the walls, and side sills 440 running fore-and-aft along lower portions the side sheets of sidewalls 434. In some instances car 420 may have stub center sills at either end, in which case sidewalls 434 may act as deep beams, and may carry vertical loads to main bolsters that extend laterally from the centerplates. In the embodiment illustrated, there may be a straight through center sill 442, and the side beams may have significant vertical bending resistance. Draft gear and releasable couplers, articulated connectors, or draw-bars may be mounted at either end of the center sill.

The interior of car body 422 may include end slope sheets 444 and lateral partition walls or bulkheads such as may be identified as 446 that may extend between the sidewalls of the car, in a manner such as may tend to divide the internal space 448 of car body 422 into two or more sub-compartments, sub-volumes or subspaces, such as may be indicated generally as two end sub-compartments 450, and three internal sub-compartments 452, each of which may be referred to as a hopper. The number of hoppers may be more or less than that shown. In this example, each of the sub-compartments may have a cross-wise extending partition wall 446 that is substantially or predominantly vertical, in contrast to car 20, in which the cross-wise extending members were predominantly inclined sheets, namely items 44 and 46. Partition wall 446 may include an upper margin that dips down in the middle. The central dip may have a relatively large radius, and may give onto outboard tangents that run to the top chords. Partition wall 446 may perform the function of a shear web linking the top chords, the side sills, the sidewall stiffeners, and the center sill. The upper edges may function as diagonal wall braces. In some embodiments the lateral partition walls may have a central reinforcement 429, sometimes referred to as a "horse collar", mounted about the nadir, or low central region, of the upper margin of the partition wall 446. Partition wall 446 may be made of a single, monolithic profile cut sheet, or may be made by joining two (or more) sheets together to form a web or panel. For example, partition wall 446 may include left and right half sheets, 432, joined along the centerline of the car. Each half sheet may have a generally trapezoidal shape, with a long side for mating with the adjacent sidewall, a parallel short side locatable at the car centerline, a bottom edge running laterally between the two upstanding sides, and a generally diagonal upper edge. The inboard upper corner may include a radius conforming to the profile of, or defining the profile of, the central dip. There may be a horse collar reinforcement 429 on one or both sides of partition wall 446, as at 431 and 433. Either or both of central reinforcements 431 or 433 may be in the nature of a doubler plate having a first margin conforming generally to the upper margin of the central portion of the partition. The reinforcements may be welded in place or may be mounted with an array of mechanical fasteners, such as rivets or Huck™ bolts, as illustrated. In some embodiments, one or other reinforcement, e.g., item 431, may include a downwardly extending stem 435. Where partition wall 446 is made of more than one piece, e.g., substantially equal halves as illustrated, the central reinforcement, or reinforcements, may tend to overlap the seam, as at the vertical seam at the centerline of the car. Further, the remaining outboard and upwardly extending portion of the upper margin of partition 446 may be reinforced, such as by reinforcements in the nature of angles 436 on one or both sides, which may themselves run generally diagonally toward the top chords 438. The laterally outboard vertical margins of partitions 446 may be connected to the sidewalls 434 at the upstanding side post reinforcements, such as may be in the nature of angles 439.

Sidewalls 434 of car 420 may include substantial main vertical side posts 454 at the longitudinal stations of the main bolsters, and further intermediate sideposts 456 along the side beams of the car. In particular, each of the four internal bulkhead partitions 446 may be located at a station abreast of vertical sideposts 456. Sideposts 454 and 456 may extend in a predominantly upstanding manner, and may be connected to side sills 440 and top chords 438.

Car 420 may include discharge sections 460 whence lading may exit the car. In this instance, there may be a center sill shroud 462, presenting an inverted V shape such as may tend to shed lading to either side, and depending inboard discharge chute sidewall members 464 that adjoin, and extend downwardly from the lower margins of shroud 462. The members may tend to hang substantially vertically. Side sills 440 may have a generally upwardly extending leg 466, to which the lower ends of the vertical sidewall posts may be rooted. Side sills 440 may also have an inwardly extending leg 458. The discharge section may include an outboard skirt, or chute side cheek, or sheet, or sidewall member 468, that may extend in a predominantly vertical plane generally downward and inboard of side sill 440, and a transition member, or shroud, or portion 469, whether formed integrally therewith or joined thereto on assembly. Transition portion 469 may have a first margin adjoining, and forming a sealed margin with, the wall sheet of sidewall 434, may have an inwardly and downwardly sloping portion, and may have an inboard margin adjoining, or formed integrally with, the upper margin of sidewall member 468. Sidewall members 464 and 468 may be trapezoidal or triangular in shape, or, more generally, to have a pointy shape in the downward direction, as at 467, the adjacent vertices of the pointy direction corresponding to the stationary and moving sides of the gate. However, sidewall members 464 and 468 may also be straight-through members of constant section that run continuously along the side sill and center sill. In either case, sidewall members 464 and 468 may define two sides of a generally four sided discharge chute 465, those two sides being roughly parallel, and spaced apart by a distance that may correspond generally to a clearance distance between the center sill and the side sill.

The other two sides of the outlet, or discharge chute, may be defined by at least one moving wall, identified as a door assembly 470, and a mating wall 472, which may be either moving (as in a double door), or stationary. In the embodiment of FIGS. 7*a*-7*g*, mating wall 472 may be a fixed chute wall 474 that has lateral flanged edges or angle members 475 that may be mechanically attached (as by Huck bolts, for example) to sidewall members 464, 468. Fixed chute wall 474 may have a laterally extending lower distal margin 476 that may be flexible in the manner of any of the seal members described above.

Door assembly 470 may be mounted to, and driven by, a door mechanism 480 such as is generally described in US published patent application publication No. US 2004/0244638 of Taylor, published Dec. 9, 2004. Such a door mechanism 480 may impose a moving force on a lateral door pan reinforcement member 482, which may both stiffen the distal margin of each door pan 484, but also act as a yoke joining two adjacent door pans together, and compelling common motion between them. Door pans 484 may have a laterally reinforced proximal margin nearest their hinge axis, and splayed reinforcements 486 running between the distal and proximal margins. Each door pan 484 may include a flat central portion 488, and inboard and outboard wings 490, 492. Wings 490 and 492 may be bent on generally parallel bends, and may be bent upwardly at something less than a right angle, such that the distal margins 494 of wings 490 and 492 may have a tendency to splay somewhat outwardly. Wings 490, 492 may then be squeezed between sidewall members 464 and 468 in a spring loaded interference fit. The spring loading may tend to bias margins 494 to ride against the adjacent surfaces of the sidewall members, in such a manner as to form a locus of contact, such as might be termed a seal, such as may tend to impede passage of aggregate lading therepast. On closing, the laterally extending, distal margin 496 of door pan 484 may engage, and deflect in a resilient, sprung manner, the co-operating opposed distal margin of fixed chute wall 474.

The moving door panel may be mounted on a dog-legged hinge arm 481. That is, flat central portion 488 may be substantially planar, with the center of rotation of the door not being co-planar with the flat central portion. Rather, the hinge may be mounted at the end of the dog leg arm 479 that stands out of the plane of pan 484. The structure of car 420 may include a laterally extending member 483, and a door hinge housing 485. Member 483 may include an inclined leg extending outwardly and downwardly from one of the partitions 446, and a depending leg extending generally downwardly from the outer margin of the inclined leg. The internal space so defined behind the shroud of member 483 may accommodate movement of the upper portion of the door to the open position, and the door hinge housing mounted thereto may accommodate the hinge.

Various embodiments have been described in detail. Since changes in and or additions to the above-described examples may be made without departing from the nature, spirit or scope of the invention, the invention is not to be limited to those details.

We claim:

1. A ridge structure for a railroad hopper car, the hopper car having first and second lengthwise running sidewalls and first and second hoppers located between the sidewalls, the first hopper being lengthwise next adjacent to the second hopper, each of the sidewalls having an upper margin and a top chord running therealong, the first hopper including a first slope sheet, the second hopper including a second slope sheet, each of the first and second slope sheets having a respective upper margin running cross-wise between the sidewalls of the hopper car, the first and second slope sheets being inclined upwardly toward each other such that their respective upper margins are mutually proximate, the slope sheets then defining flanks sloped toward an apex at which said ridge structure is located, and wherein said ridge structure comprises:

first and second end portions for mounting to the first and second sidewalls respectively; and a central portion extending cross-wise between said first and second end portions;

said central portion having an upper edge, said upper edge being lower than the top chords;

said upper margin of said first slope sheet being mated to said central portion;

said upper margin of said second slope sheet being mated to said central portion;

said central portion extending upwardly proud of said upper margin of said first slope sheet and said upper margin of said second slope sheet; and said first and second end portions each having an upper margin extending upwardly and laterally outwardly from said central portion to the first and second sidewalls respectively.

2. The ridge structure of claim 1, wherein said first and second end portions are substantially triangular in shape.

3. The ridge structure of claim 1, wherein said central portion is a substantially planar solid plate having upper and lower portions, said upper portion extending upwardly proud of the upper margins of the first and second slope sheets, and said lower portion extending downwardly of the upper margins of the first and second slope sheets.

4. The ridge structure of claim 1 wherein:

said upper edge of said central portion of said ridge structure runs horizontally;

said first and second end portions define respective end gussets, each end gusset having an upper edge running on an upward and outboard diagonal incline;

and said first and second end portions each have an outboard edge, said outboard edge running vertically along, and being mated to a respective one of, said first and second sidewalls, and said outboard edge has an upper end terminating adjacent a top chord of the respective sidewall.

5. The ridge structure of claim 1, wherein said end portions and said central portion are welded together.

6. The ridge structure of claim 5, wherein said central portion has a thickness in the range of ½ inch to ¾ inch.

7. The ridge structure of claim 1, wherein said central portion is formed of a flat bar.

8. The ridge structure of claim 1, wherein said end portions and said central portion are cut from a single monolithic piece of stock.

9. A ridge structure for a railroad hopper car, the hopper car having first and second lengthwise running sidewalls and first and second hoppers located between the sidewalls, the first hopper being lengthwise next adjacent to the second hopper, the first hopper including a first slope sheet, the second hopper including a second slope sheet, each of the first and second slope sheets having a respective upper margin running cross-wise between the sidewalls of the hopper car, the first and second slope sheets being inclined upwardly toward each other such that their respective upper margins are mutually proximate, the slope sheets then defining flanks sloped toward an apex at which said ridge structure is located, and wherein said ridge structure comprises:

first and second end portions for mounting to the first and second sidewalls respectively; and a central portion extending cross-wise between said first and second end portions;

said upper margin of said first slope sheet being mated to said central portion;

said upper margin of said second slope sheet being mated to said central portion;

said central portion extending upwardly proud of said upper margin of said first slope sheet and said upper margin of said second slope sheet; and said first and second end portions extending upwardly and laterally outwardly from said central portion to the first and second sidewalls respectively;

said first and second end portions are substantially triangular in shape; and each of said first and second end portions has an outboard margin that mates with, and extends upwardly against one of, the sidewalls.

10. A ridge structure for a railroad hopper car, the hopper car having first and second lengthwise running sidewalls and first and second hoppers located between the sidewalls, the first hopper being lengthwise next adjacent to the second hopper, each of the sidewalls having an upper margin and a top chord running therealong, the first hopper including a first slope sheet, the second hopper including a second slope sheet, each of the first and second slope sheets having a respective upper margin running cross-wise between the sidewalls of the hopper car, the first and second slope sheets being inclined upwardly toward each other such that their respective upper margins are mutually proximate, the slope sheets then defining flanks sloped toward an apex at which said ridge structure is located, and wherein said ridge structure comprises:

first and second end portions for mounting to the first and second sidewalls respectively; and a central portion extending cross-wise between said first and second end portions;

said upper margin of said first slope sheet being mated to said central portion;

said upper margin of said second slope sheet being mated to said central portion;

said central portion extending upwardly proud of said upper margin of said first slope sheet and said upper margin of said second slope sheet; and said first and second end portions extending upwardly and laterally outwardly from said central portion to the first and second sidewalls respectively;

said central portion of said ridge structure has a horizontally running upper edge, and said first and second end portions define end gussets, each end gusset having an upper edge running on an upward and outward diagonal incline and said first and second end portions have an outboard edge mated to the first and second sidewalls respectively.

11. A rail road hopper car body, comprising:

a pair of opposed cross-wise running first and second end walls;

a pair of opposed lengthwise running first and second sidewalls mounted between said end walls, each of said sidewalls having an upper margin, and a top chord running along said upper margin;

a plurality of slope sheets extending between said sidewalls, said plurality of slope sheets including a first slope sheet and a second slope sheet, said first slope sheet being a slope sheet of a first hopper, and said second slope sheet being a slope sheet of a second hopper, said second hopper being next lengthwise adjacent to said first hopper;

said first and second slope sheets of said first and second hoppers sloping upward toward each other;

said first and second slope sheets of said first and second adjacent hoppers each having a respective upper margin;

a ridge member mounted cross-wise between said sidewalls, said upper margins of said first and second slope sheets mating with said ridge member;

said ridge member having first and second end portions and a central portion extending between said first and second end portions;

said first and second end portions being attached to said first and second sidewalls respectively; and said first and second end portions each having an upper margin inclining upwardly outboard from said central portion to the first and second sidewalls respectively.

12. The rail road hopper car body of claim 11, wherein said first and second end portions are each substantially triangular in shape.

13. The rail road hopper car body of claim 11, wherein said ridge member has an upper portion and a lower portion, said upper portion being upwardly proud of said upper margins of said first and second slope sheets.

14. The rail road hopper car body of claim 11, wherein said end portions and said central portion are welded together.

15. The rail road hopper car body of claim 11, wherein said end portions and said central portion are fabricated from a single monolithic piece of stock.

16. The rail road hopper car body of claim 11, wherein said central portion is formed of a flat bar.

17. The rail road hopper car body of claim 11, wherein:

said central portion of said ridge member has an height dimension;

one hopper of said hopper car has an end slope sheet, said end slope sheet having a vertical rise dimension; and said height dimension of said central portion of said ridge member is less than 20% of the vertical rise dimension of said end slope sheet.

18. A rail road hopper car body, comprising:

a pair of opposed cross-wise running first and second end walls;

a pair of opposed lengthwise running first and second sidewalls mounted between said end walls;

a plurality of slope sheets extending between said sidewalls, said plurality of slope sheets including a first slope sheet and a second slope sheet, said first slope sheet being a slope sheet of a first hopper, and said second slope sheet being a slope sheet of a second hopper, said second hopper being next lengthwise adjacent to said first hopper;

said first and second slope sheets of said first and second hoppers sloping upward toward each other;

said first and second slope sheets of said first and second adjacent hoppers each having a respective upper margin;

a ridge member mounted cross-wise between said sidewalls, said upper margins of said first and second slope sheets mating with said ridge member;

said ridge member having first and second end portions and a central portion extending between said first and second end portions;

said first and second end portions being attached to said first and second sidewalls respectively;

said first and second end portions are each substantially triangular in shape and include an upper margin that inclines upwardly outboard from said central portion toward the respective one of said first and second sidewalls to which that end portion is mated; and each of said first and second end portions has an outboard margin that mates with, and extends vertically upwardly against, a respective one of said sidewalls.

19. A rail road hopper car body, comprising:

a pair of opposed cross-wise running first and second end walls;

a pair of opposed lengthwise running first and second sidewalls mounted between said end walls;

a plurality of slope sheets extending between said side walls, said plurality of slope sheets including a first slope sheet and a second slope sheet, said first slope sheet being a slope sheet of a first hopper, and said second slope sheet being a slope sheet of a second hopper, said second hopper being next lengthwise adjacent to said first hopper;

said first and second slope sheets of said first and second hoppers sloping upward toward each other;

said first and second slope sheets of said first and second adjacent hoppers each having a respective upper margin;

a ridge member mounted cross-wise between said sidewalls, said upper margins of said first and second slope sheets mating with said ridge member;

said ridge member having first and second end portions and a central portion extending between said first and second end portions;

said first and second end portions being attached to said first and second sidewalls respectively; and a gusset mounted between said first and second slope sheets of said first and second adjacent hoppers downwardly of said ridge member, said first and second slope sheets and said gusset co-operating to define a tube extending cross-wise between said first and second sidewalls.

20. The rail road hopper car body of claim 19 wherein:

said body has a coupler centerline height;

said first and second sidewalls each include a top chord and a side sheet extending downwardly from said top chord;

each said top chord has a flange and a lower margin, said flange being located upwardly of said lower margin;

said gusset is located at an height that is more than half way from the coupler centerline height to the top chord flange;

said tube is a triangular tube, said triangular tube having first and second ends mated to said slope sheets of said first and second sidewalls respectively;

said first and second end portions have a laterally outboard edge defining a vertical stem mated to said first and second sidewalls respectively, each said vertical stem having an upper end overlapping said lower margin of said top chord;

whereby said triangular tube and said first and second end portions co-operate to discourage cross-wise deflection of said top chords.

* * * * *